US006892898B1

(12) United States Patent
Boone et al.

(10) Patent No.: US 6,892,898 B1
(45) Date of Patent: May 17, 2005

(54) METERING NAPKIN DISPENSER

(75) Inventors: Bruce T. Boone, Orange Park, FL (US); Gregory D. Budz, Sobieski, WI (US); Michael R. Kilgore, Little Suamico, WI (US); Jonathan R. Aumann, DePere, WI (US); James B. Christensen, Green Bay, WI (US)

(73) Assignee: Georgia-Pacific Corporation, Atlanta, GA (US)

( * ) Notice: Subject to any disclaimer, the term of this patent is extended or adjusted under 35 U.S.C. 154(b) by 16 days.

(21) Appl. No.: 10/611,444

(22) Filed: Jul. 1, 2003

Related U.S. Application Data

(62) Division of application No. 09/917,048, filed on Jul. 27, 2001, now Pat. No. 6,622,888.

(60) Provisional application No. 60/274,678, filed on Mar. 9, 2001.

(51) Int. Cl.[7] ..... B65H 3/00

(52) U.S. Cl. ..... 221/36; 221/213

(58) Field of Search ..... 221/38, 36, 40, 221/293, 292, 296, 298, 213, 210; 271/131, 134, 137, 113

(56) References Cited

U.S. PATENT DOCUMENTS

| | | | | |
|---|---|---|---|---|
| 1,158,547 A | | 11/1915 | Parsons | |
| 1,158,548 A | | 11/1915 | Parsons | |
| 1,158,549 A | | 11/1915 | Parsons | |
| 1,158,550 A | | 11/1915 | Parsons | |
| 1,440,897 A | | 1/1923 | Sommer | |
| 2,193,334 A | | 3/1940 | Kirch | 312/60 |
| 2,850,345 A | | 9/1958 | Marcuse et al. | 312/39 |
| 2,932,426 A | | 4/1960 | Hope et al. | 223/36 |
| 3,702,187 A | | 11/1972 | Hageman et al. | 271/29 |
| 3,872,997 A | * | 3/1975 | Armstrong et al. | 221/20 |
| 3,912,124 A | | 10/1975 | Pinkerton | 221/298 |
| 3,960,291 A | | 6/1976 | Navi | 221/36 |
| 4,155,484 A | | 5/1979 | Pastore | |
| 4,938,382 A | | 7/1990 | Frazier et al. | 221/45 |
| 4,953,746 A | | 9/1990 | Andriash | 221/35 |
| 5,100,020 A | | 3/1992 | Petterson et al. | 221/45 |
| 5,219,092 A | | 6/1993 | Morand | 221/53 |
| 5,810,200 A | | 9/1998 | Trokhan | 221/55 |
| 6,135,315 A | | 10/2000 | Gremillion, III et al. | 221/259 |

FOREIGN PATENT DOCUMENTS

| | | | |
|---|---|---|---|
| FR | 2 481 240 | 10/1981 | B65H/1/26 |
| SE | 446 403 | 3/1968 | |

* cited by examiner

*Primary Examiner*—Kenneth Noland
(74) *Attorney, Agent, or Firm*—Michael W. Ferrell

(57) ABSTRACT

A product metering napkin dispenser includes a housing defining a storage magazine for receiving a stack of folded napkins and a metering member that penetrates the stack in order to segregate a predetermined number of napkins from the remainder of the stack for dispensing. Preferred embodiments include gravity feed napkin dispensers. In various embodiments the metering member may include: a pivoting plate cooperating with a hinged trap door support surface; a rotating semicircular disk co-rotating with a support disk; or a reciprocating jaw assembly urging napkins through an aperture.

47 Claims, 26 Drawing Sheets

METERING NAPKIN DISPENSER

CLAIM OF PRIORITY

This patent application is a patent application of U.S. Ser. No. 09/917,048, filed Jul. 27, 2001, now U.S. Pat. No. 6,622,888, which application was based on U.S. Provisional Patent Application Ser. No. 60/274,678, filed Mar. 9, 2001. The priorities of the foregoing applications are hereby claimed.

TECHNICAL FIELD

The present invention relates generally to napkin dispensers, and more particularly to a metering napkin dispenser provided with a napkin storage magazine for receiving a stack of folded napkins and a metering member adapted to penetrate the stack to segregate a predetermined number of napkins for dispensing.

BACKGROUND

Dispensers for sheet products are known in the art; such articles may be relatively simple depending on the product and the result desired. There is shown in U.S. Pat. No. 5,810,200 to Trokhan, for example, a tissue package provided with a dispensing opening through which tissues are dispensed. There is disposed in the opening an engaging tab which separates one tissue from another when a tissue is pulled thereover by a user.

Other devices for dispensing sheet products may be more complex, for instance, when it is desired to distribute one article at a time. Illustrative in this regard are U.S. Pat. No. 4,953,746 to Andriash for a one-at-a-time coupon dispenser and U.S. Pat. No. 6,135,315 to Gremillion III et al. for a newspaper vending method and apparatus. So also, metering paper towel dispensers are typically those where a continuous roll or fan-fold sheet is advanced and cut to a desired length; see U.S. Pat. No. 2,850,345 to Marcuse et al.

Devices for dispensing stacks of folded napkins or paper towels are generally gravity feed devices, or spring biased devices where the stack is urged to a dispensing aperture by a follower, where they are pulled from the opening by a user. Various designs have been employed to prevent binding, tearing, bunching or the distribution of large clumps of napkins which can be wasteful since they will be unnecessarily discarded.

In the U.S. Pat. No. 4,155,484 to Pastore there is shown a napkin dispenser adapted to receive two stacks of napkins. The napkins are urged by respective spring members to a dispensing aperture where they may be grasped and removed by a user.

U.S. Pat. No. 4,938,382 to Frazier et al. discloses a cabinet for dispensing paper sheets from a stack provided with a restricting means for preventing a technician from overfilling the device. Such overfilling can create unwanted pressure about the dispensing aperture and prevent proper operation.

U.S. Pat. No. 5,100,020 to Petterson et al. discloses a dispenser apparatus for serially dispensing products such as paper napkins from a stack. The dispenser apparatus includes a housing which has a radius of curvature corresponding to the radius of curvature of a stack of folded napkins. The folded napkins are of non-uniform thickness by virtue of the fact that they are unequally folded (FIG. 3) so that a stack has an inherent tendency to curve when stacked.

U.S. Pat. No. 5,219,092 to Morand discloses a dispenser for dispensing interleaved folded towels. The dispenser has front and back walls joined by sidewalls and a bottom wall defining a dispensing slot. The dispenser is provided with a plurality of supports projecting inwardly from the interior of the front and back walls for partially supporting substacks of paper towels in the dispenser. The supports reduce the weight carried on the bottom of each sub-stack. Further provided is a stepped bottom profile to facilitate dispensing.

SUMMARY OF INVENTION

Napkin dispensers are desirably relatively simple to operate and are preferably of robust and inexpensive construction. A particularly desirable feature of the invention is the dispensing of a predetermined number of napkins in response to the action of a metering member. There is provided generally in accordance with the present invention a product metering napkin dispenser including: (a) a napkin magazine for receiving a stack of folded napkins; (b) shelf means for releasably retaining the stack of napkins about a terminal portion of the napkin magazine; (c) a metering member; and (d) means for providing relative motion between the metering member and the shelf means. The dispenser is configured such that the metering member penetrates the stack of napkins a predetermined distance from the shelf means in a metering operation thereby segregating a pre-determined number of napkins from the remainder of the stack for dispensing. In some embodiments both the metering member and the shelf means are moveable with respect to the napkin storage magazine, whereas in other embodiments either the metering member or the shelf means may be stationary.

A particularly advantageous construction of the inventive dispenser includes a housing for receiving a stack of folded napkins, a movable shutter for retaining the stack in a closed position and a metering member configured so as to be capable of metering a predetermined number of napkins to be dispensed while retaining the stack in the housing during a dispensing operation. The shutter and the metering member are configured to cooperate in a dispensing operation such that the metering member penetrates the stack of napkins to segregate a predetermined number of napkins from the remainder of the stack and retain the remainder of the stack in the housing while the shutter moves to an open position and the segregated napkins are dispensed.

In one preferred embodiment a product metering, napkin dispenser includes a pivoted metering member and a trapdoor shelf. There is thus provided in accordance with one embodiment of the present invention: (a) a housing defining a napkin magazine for receiving a stack of folded napkins; (b) a moveable shutter hinged to the housing for retaining the stack of folded napkins in the housing in a closed position; (c) a metering member pivotally mounted on the housing and coupled to the moveable shutter, the metering member being configured so as to be capable of retaining the stack of folded napkins in the housing, wherein the moveable shutter and the metering member are positioned, configured and dimensioned to cooperate to dispense a predetermined number of napkins in a dispensing operation whereupon pivotal motion of the metering member; (i) the metering member penetrates the stack of folded napkins a pre-determined distance from the moveable shutter in the closed position thereby segregating the pre-determined number of napkins from the remainder of napkins in the stack and thereby retaining the remainder of the napkins in the stack; and (ii) the hinged moveable shutter swings to an open position thereby releasing the predetermined number of napkins. One way of coordinating the motion of the metering member and the hinged shutter is by way of a cam member coupled to the moveable shutter having a cam surface which engages the metering member. Most preferably, the napkin dispenser is a gravity-feed napkin dispenser.

In another preferred embodiment a metering napkin dispenser in accordance with the present invention is provided with a pair of co-rotating shutters mounted to rotate concurrently in order to dispense a pre-determined number of napkins. There is thus provided: (a) a housing defining a napkin magazine for receiving a stack of folded napkins; (b) a moveable retaining shutter mounted to rotate in a dispensing plane for retaining the stack of napkins in a closed position; (c) a metering shutter mounted to rotate concurrently with the moveable support shutter at a pre-determined distance from the support shutter, wherein the moveable shutter and the metering member are positioned configured dimensioned to cooperate to dispense a pre-determined number of napkins in a dispensing operation whereupon rotation of the retaining shutter and metering shutter: (i) the metering shutter revolves to penetrate the stack of folded napkins at a pre-determined distance from the moveable shutter thereby segregating the pre-determined number of napkins from the remainder of napkins in the stack and thereby retaining the remainder of napkins in the stack; and (ii) the moveable shutter revolves to an open position thereby releasing the pre-determined number of napkins. One convenient way to construct the dispenser in accordance with this embodiment is to mount the moveable support shutter and the metering shutter about a single rotatable shaft.

In yet another embodiment there is provided a product metering, gravity feed napkin dispenser including: (a) a housing defining a napkin magazine for receiving a stack of folded napkins; (b) a support releasably supporting the stack of folded napkins about a dispensing plane at a terminal portion of the napkin magazine; (c) a metering carriage provided with a napkin metering member projecting from the metering carriage; (d) a guide configured for directing the metering carriage during operation of the napkin dispenser, the guide having an inward portion and an outward portion, the inward portion being disposed proximately to the stack of folded napkins for guiding the metering carriage downwardly during a dispensing stroke over which napkins are dispensed and the outward portion being disposed outwardly with respect to the inward portion for guiding the metering carriage upwardly following the dispensing stroke; (e) biasing means to urge the metering carriage upwardly to a rest position; and (f) drive means coupled to the metering carriage for advancing the metering carriage along the guide in the dispensing cycle, the drive means being generally adapted to overpower the force exerted on the metering carriage by the biasing means. The guide and metering carriage are configured and arranged such that during the dispensing stroke the metering member penetrates the stack of folded napkins at a pre-determined distance above the dispensing plane and exerts a downward force on a pre-determined number of folded napkins which are thereby released from the support as the metering carriage advances downwardly along the inward portion of the guide. A particularly preferred embodiment includes a gripping member adapted to cooperate with the metering member to grip the pre-determined number of folded napkins between the metering member and the gripping member during the dispensing stroke.

In still yet another aspect of the present invention there is provided a method of dispensing a pre-determined number of folded napkins from a napkin stack including the steps of: (a) disposing a stack of folded napkins in a napkin magazine atop a support releasably supporting the stack; (b) penetrating the stack with a metering member such that the metering member is between the pre-determined of napkins and the remainder of napkins in the stack; and (c) providing relative motion between the support and the metering member operative to dispense the pre-determined number of napkins. These and other aspects and features of the present invention are discussed in detail below.

BRIEF DESCRIPTION OF DRAWINGS

The invention is described with reference to the appended drawings wherein.

In the various embodiments illustrated, like numerals indicate the identical part thereof.

DETAILED DESCRIPTION

Figure 1:
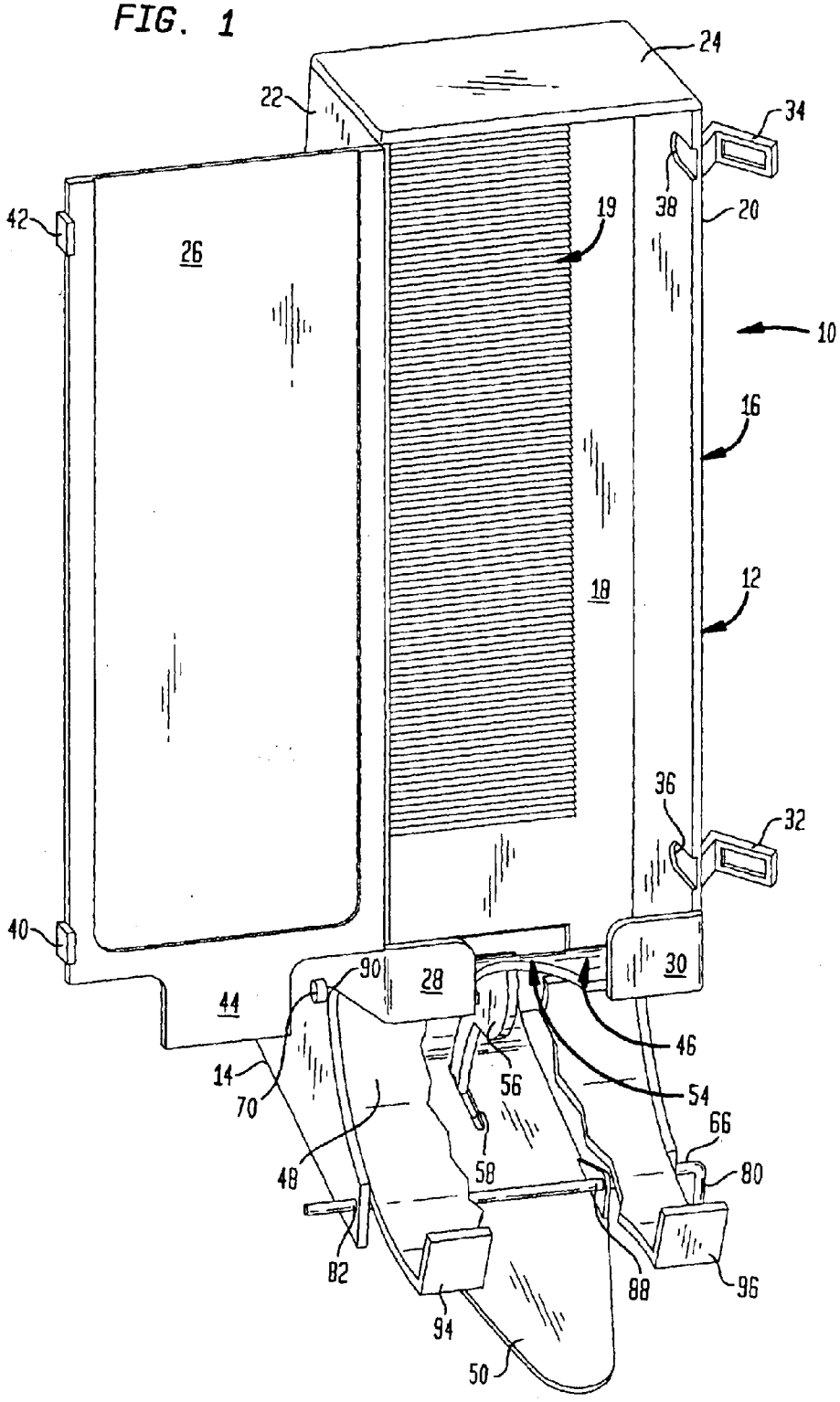
FIG. 1 is a front view in perspective of a first napkin dispenser constructed in accordance with the present invention.

The invention is described in detail below with reference to the various figures. Such description is for purposes of exemplification and illustration only and is in no way limitative of the present invention. Modifications to particular embodiments within the spirit and scope of the invention exemplified will be readily apparent to those of skill in the art.

The present invention includes gravity-feed product metering napkin dispensers having: (a) a napkin magazine or storage compartment for receiving a stack of folded napkins; (b) shelf means for releasably supporting the stack of folded napkins and thereby retaining the napkins in the housing; (c) a metering member; and (d) means for providing relative motion between the metering member and the shelf means wherein the shelf means, metering member and the means for providing relative motion between the metering member and the shelf means are configured and arranged such that the metering member penetrates the stack of napkins a pre-determined distance from the shelf means in a metering operation thereby segregating a pre-determined number of napkins from the remainder of the stack for dispensing. Numerous embodiments of the invention may be constructed. Typically, the shelf means are located about the lower portion of the napkin magazine. In some embodiments, the metering member is mounted such that it advances to penetrate the stack in the metering operation and retracks so as to allow the napkins to advance toward the shelf means in between metering operations. In some preferred embodiments, the shelf means are moveable with respect to the stack of folded napkins in the napkin magazine. For example, in one embodiment the shelf means are hinged about the lower portion of the napkin magazine so as to swing downwardly to release napkins while a metering plate supports the stack. In another embodiment a support plate and a metering plate are rotatably mounted about a shaft and are configured to release napkins upon rotation of the shaft.

The metering member may or may not be moveable with respect to the napkin stack. In a preferred embodiment the metering member is pivotably mounted and has an arcuate plate portion adapted to penetrate the stack in the metering operation. In another embodiment the metering member comprises a generally planar member rotatably mounted about a shaft adapted to penetrate the stack upon rotation of the shaft. In still yet another embodiment, the metering member is mounted on a metering carriage adapted for reciprocating motion with respect to the stack of folded napkins. Alternatively, the metering member could be stationary and the support shelf movable with respect thereto.

In preferred embodiments the napkin dispenser is a gravity feed napkin dispenser and is inclined so as to accommodate the stack of napkins at an angle of from about 8° to about 15° with respect to a vertical. From about 10° to about 12° with respect to the vertical is typical.

The stack of folded napkins typically includes a plurality of folded napkins with a continuous surface about at least 1 edge thereof arranged in a stack such that the continuous surfaces are along one face of the stack and the metering member penetrates the stack at the face presenting the continuous surfaces of the folded napkins. The folded napkins may be provided with a plurality of panels of substantially equal size; for example, 3 or 4 panel napkins. Optionally, there may be provided a plurality of support ridges projecting into the interior of the napkin storage magazine or chamber configured to frictionally engage the stack of folded napkins and distribute its weight to the walls of the napkin dispenser.

Referring to FIGS. 1–4 there is shown a first napkin dispenser 10 including a housing 12 provided with a lower portion 14 of the housing. The housing defines a napkin storage magazine 16 with a back wall 18, support ridges 19, a right sidewall 20, and a left sidewall 22. Further provided is a top wall 24, and a door 26. There is also provided a left front retainer 28 and a right front retainer 30. Retainer 28 is spaced apart from retainer 30 so as to facilitate the loading of napkins into the dispenser as will be appreciated from the discussion which follows.

There may optionally be provided a pair of buckles 32,34 as well as a plurality of closure tabs 36–42 as shown in FIG. 1. Door 26 is optionally provided with a lower portion which covers a gap 46 between the retainers along the front of the dispenser during operation. A product receiving chute 48 is provided about the lower portion 14 of housing 12 for receiving napkins dispensed from the dispenser.

A metering lever 50 is mounted about an axle 66 for pivotal motion. Axle 66 is perhaps better seen in FIG. 4 which is an enlarged elevational view thereof. In general axle 66 has a bowed or offset configuration with a central offset portion 74 and two curved portions 76, 78 about its terminal portions. Further provided is a handle portion 80 for turning the axle. It should be appreciated from the geometry of the offset axle 66 that the position of metering lever 50 maybe adjusted by rotating handle 80.

A metering shutter 52 (FIG. 2) is attached to lever handle 50 and may be integrally formed therewith if so desired. Metering shutter 52 is actually curved planar in shape as is best appreciated perhaps from FIGS. 2 and 3 and is generally perpendicular to metering lever 50.

Figure 2:
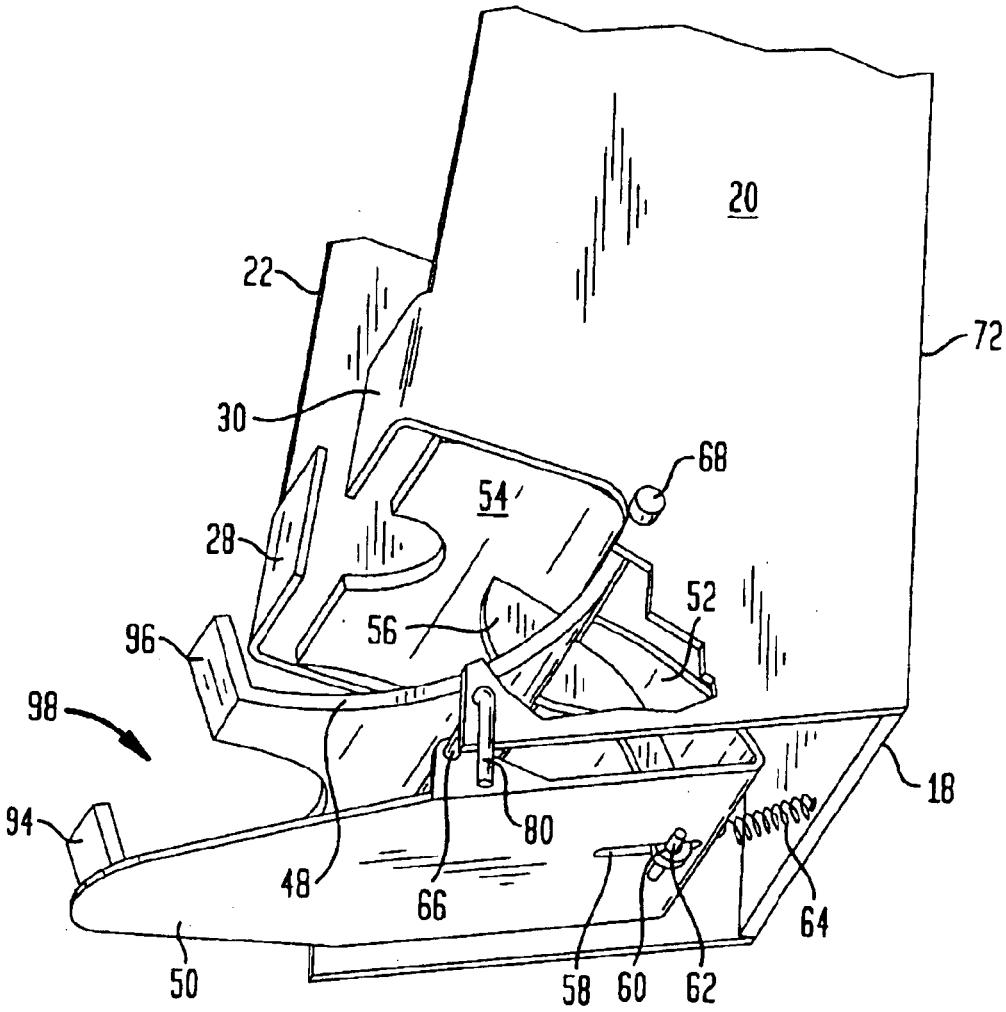
FIG. 2 is a partial view in perspective generally from the right side and partial cutaway showing various parts of the napkin dispenser of FIG. 1.
Figure 3:
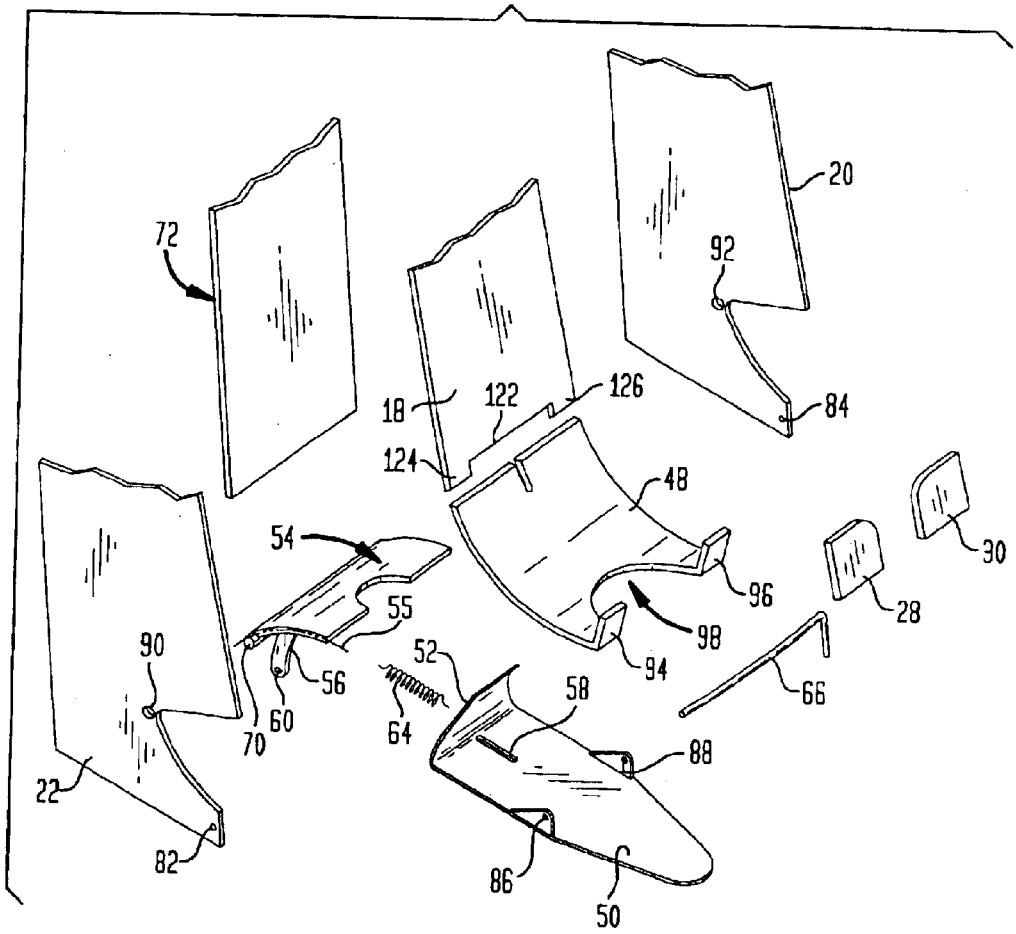
FIG. 3 is a partial exploded view showing various parts of the napkin dispenser of FIGS. 1 and 2.
Figure 4:
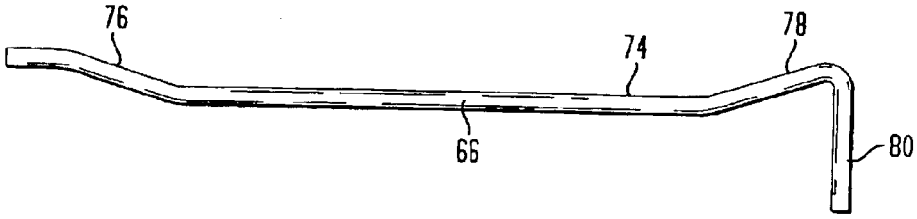
FIG. 4 is an enlarged view in elevation of the offset axle which supports the metering lever handle of the napkin dispenser of FIG. 1.

There is further provided a support shutter 54 hinged to the housing by way of a right axle portion 68 and a left axle portion 70. Support shutter 54 includes a cam 56 attached to its underside which may or may not be integrally formed with shutter 54. Cam 56 rides in a slot 58 and controls the position of support shutter 54. Cam 56 is optionally provided with means for limiting the rotation of lever 50 and may include a hole 60 holding a pin 62 as shown in FIG. 2.

In order to return lever 56 to a rest position, there is also optionally provided a spring 64 attached to lever 50 and to an outer wall 72 provided at the back of the housing rearwardly of back wall 18. The housing also includes holes 82,84 for receiving axle 66 whereas lever 50 has holes 86 and 88 which retain the metering member about the axle. The housing farther includes holes 90,92 to receive the axle portions 68,70 of support shutter 54. Another pair of retaining tabs 94,96 are placed at the end of chute 48 for retaining napkins being dispensed. Here again, a gap 98 is provided in order to facilitate the withdrawing of napkins from the dispenser.

While the inventive dispenser may be used with a variety of sheet products, it is particularly adapted to dispense folded napkins with a plurality of panels as well as a continuous surface about one edge. Suitable napkins may be 3 or 4 panel napkins with panels of substantially equal size. A 6½ by 12 inch rectangular napkin will thus have 3 panels of 6½ by 4 inches whereas in a three panel configuration and 4 panels of 6½ by 3 inches in a four panel configuration.

Figure 5A:
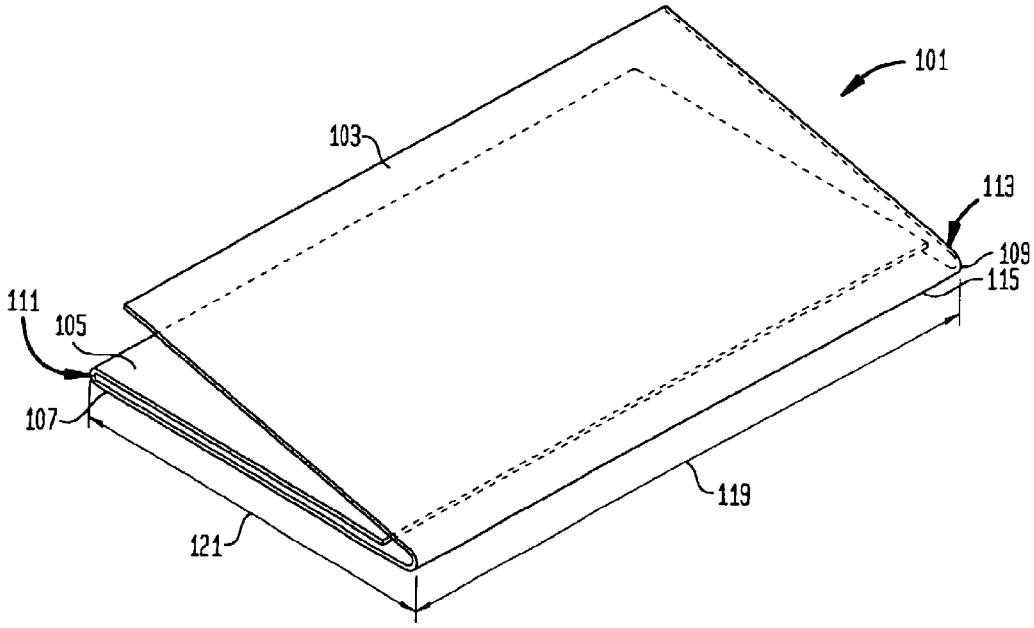
FIGS. 5A and 5B are perspective and end schematic views of a three-panel folded napkin with a continuous surface along one edge which may be used in the napkin dispensers of the present invention.
Figure 5B:
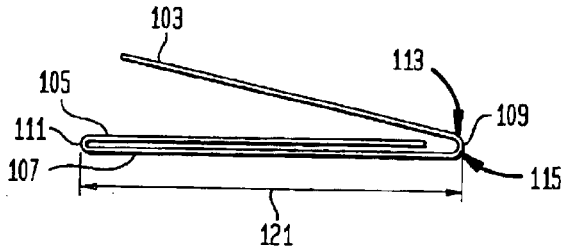

There is shown in FIGS. 5A and 5B diagrams of three panel folded napkin. FIG. 5A is a schematic perspective view showing a rectangular napkin 101 in partially folded form wherein the various panels 103, 105 and 107 are shown. Napkin 101 may be a single rectangular sheet of 6½ inches by 12 inches folded into 3 substantially equal panels as shown. There are thus two folds, 109 and 111. There is present at edge 113 a continuous surface 115 the significance of which will be appreciated from the discussion which follows.

Napkin 101 thus presents a dispensing length 119 and a dispensing width 121. The dispending length of napkin 101 is identical to a four-fold napkin of like size; however, a four fold napkin has a narrower configuration about its dispensing width as can be appreciated from FIGS. 5C and 5D.

Figure 5C:
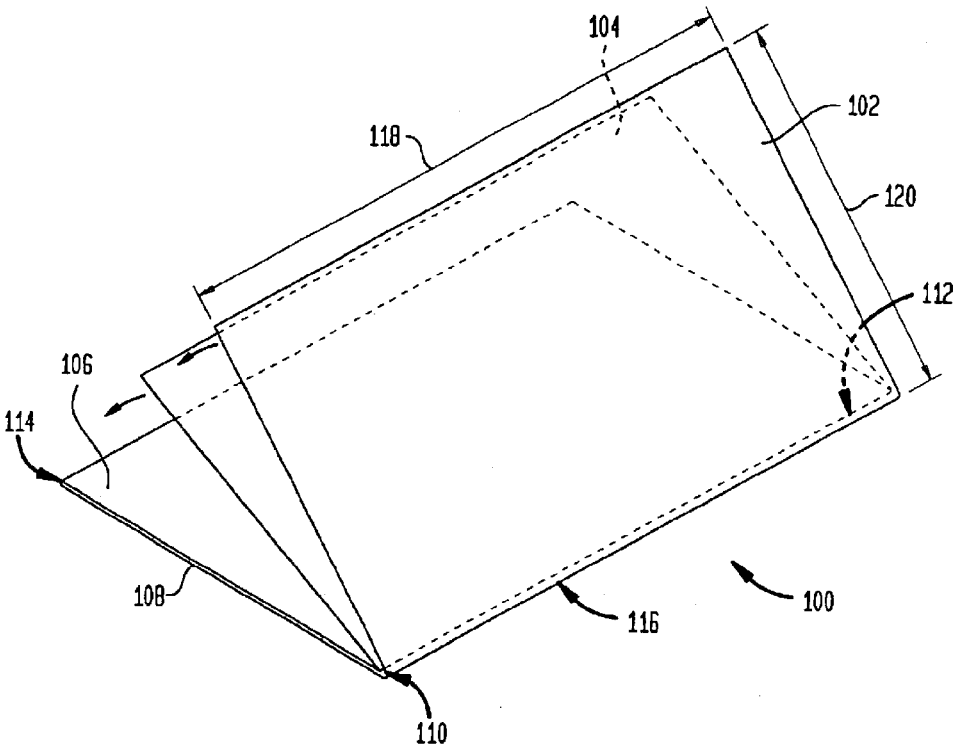
FIGS. 5C and 5D are perspective and end schematic views of a four-panel folded napkin with a continuous surface along an edge which may be used in the napkin dispenser of the present invention.
Figure 5D:
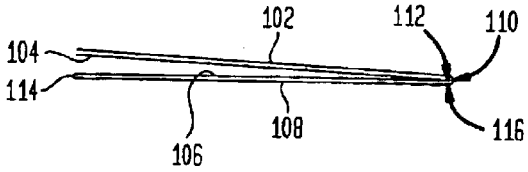

There is shown in FIGS. 5C and 5D diagrams of a suitable four-panel folded napkin. FIG. 5C is a perspective view showing a napkin 100 in partially folded form wherein the various panels 102, 104, 106 and 108 are shown partially in phantom lines. Napkin 100 may also be for example a single sheet of about 6½ inches by about 12 inches as above folded into four roughly equal panels as shown in FIGS. 5C and 5D. The napkin is folded into four panels 102, 104, 106, 108 as shown with folds 110, 112 and 114 as shown in FIGS. 5C and 5D. As will be appreciated from the diagrams the napkin is continuous at fold 110 that is, a continuous surface 116 is formed by the napkin along this edge. In general folded napkin 100 presents a dispensing length 118 and a dispensing width 120.

The significance of the napkin length and width is perhaps greater with respect to embodiments of the present invention which utilize a dispensing aperture rather than a trap door or dispensing shutter (see FIG. 18 and following), however, the support and metering shutters are generally configured so as to be large enough to support a stack of napkins to be dispensed. The napkins may be quite lightweight, however, when folded in the four panel configuration of FIGS. 5C and 5D, the napkins may have, for example, an average thickness of about 25/1000 of an inch or so (25 mils) when folded. A basis weight of from about 10 pounds per 3000 square foot ream to about 25 pounds per 3000 square foot ream may be typical. A 16 inch stack may contain 600 to 650 napkins and weigh 6 pounds or more. In general, the napkin dispenser of the present invention is adapted to accommodate a stack of such size. In this respect it might be typical to have the enclosure or storage chamber roughly ⅛ of an inch larger or more in all directions than the stack of napkins sought to be dispensed. It is preferred to orient the napkins so that their continuous surfaces such as surfaces 115, 116 are all arranged on one face of the stack and have the metering member penetrate the stack on that face so that the dispenser operates optimally. In the various embodiments illustrated herein it is preferred to orient the folded napkins of FIGS. 5A through 5D in a stack so that all of the continuous surfaces, such as 115, 116 are disposed adjacent the back wall (18 in FIGS. 1–4 and 6–8) of the napkin storage magazine and have the metering member approach through the back wall as discussed further herein. In this respect, back wall 18 defines a slot 122 between back wall portions 124,126 that is substantially shorter than dispensing length 118 or 119 of napkins to be dispensed so that the napkins are not inadvertently drawn into the dispenser mechanism. To facilitate illustration, folded napkins such as napkins 100 or 101 are shown as a single line in the diagrams which follow.

Figure 6:
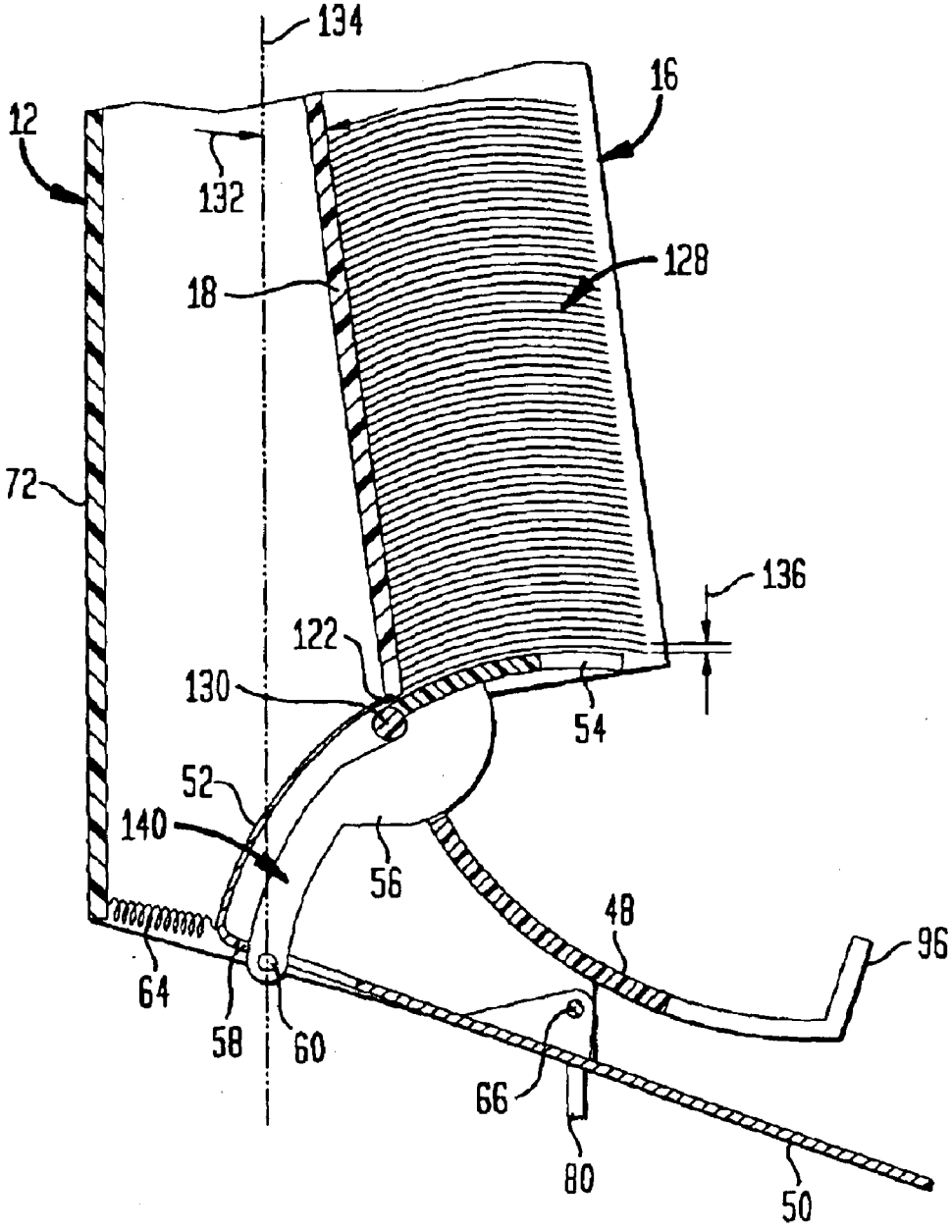
FIGS. 6–8 are partial views in section and elevation along the center line of the napkin dispenser illustrated in FIGS. 1–4 generally from the left side schematically illustrating the operation of the inventive napkin dispenser.
Figure 7:
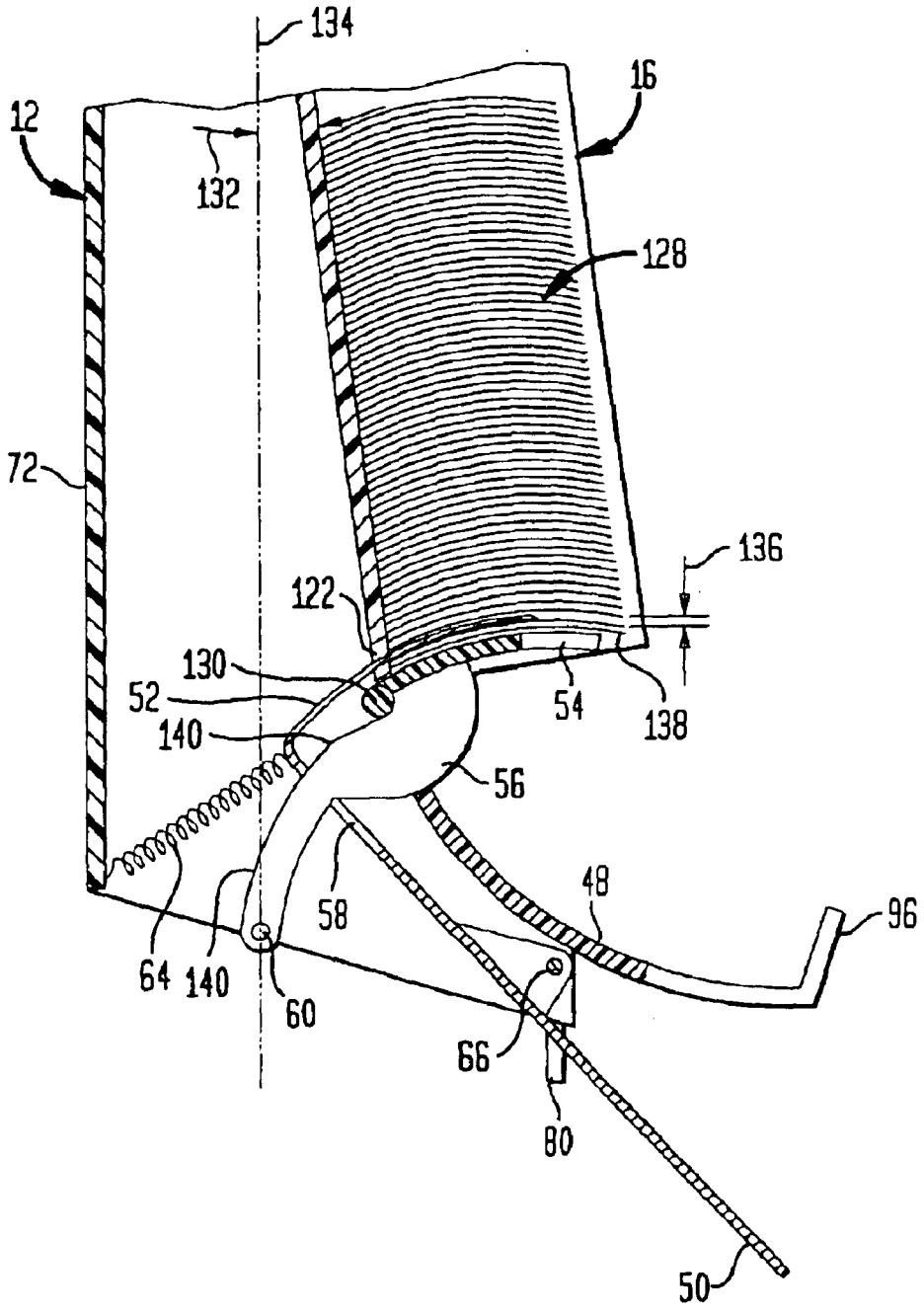
Figure 8:
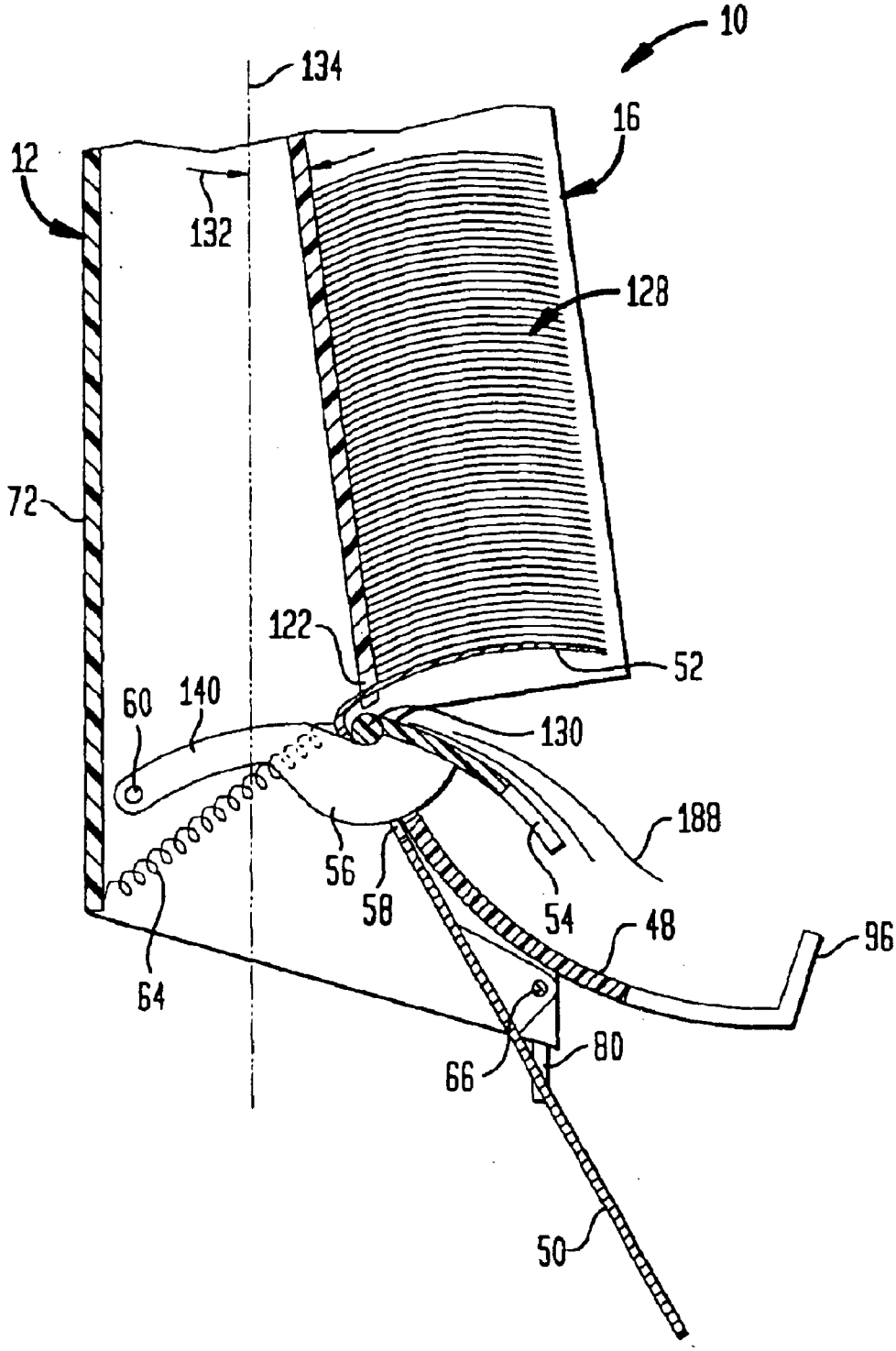
Figure 9:
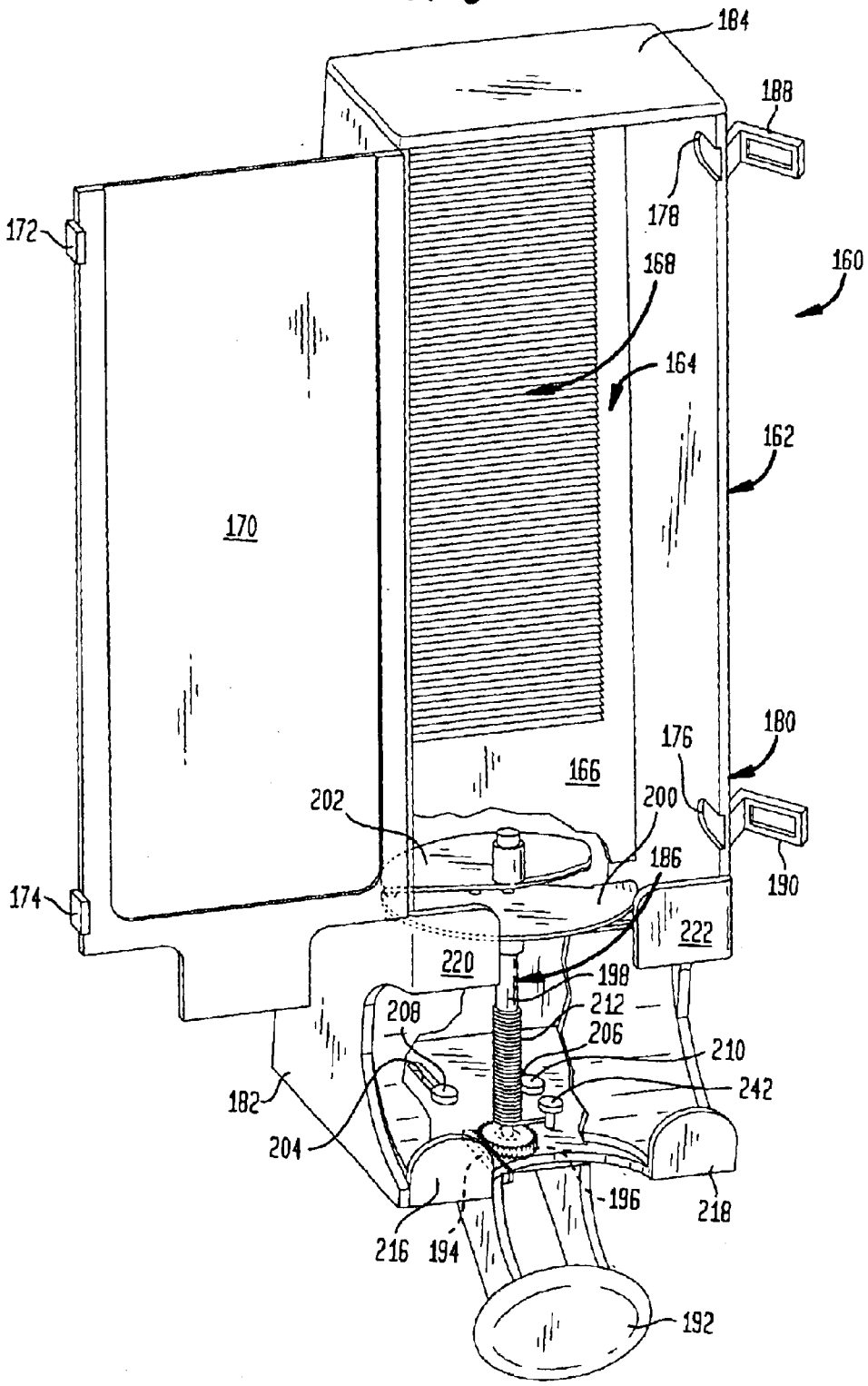
FIG. 9 is a view in perspective of another napkin dispenser constructed in accordance with the present invention.
Figure 10:
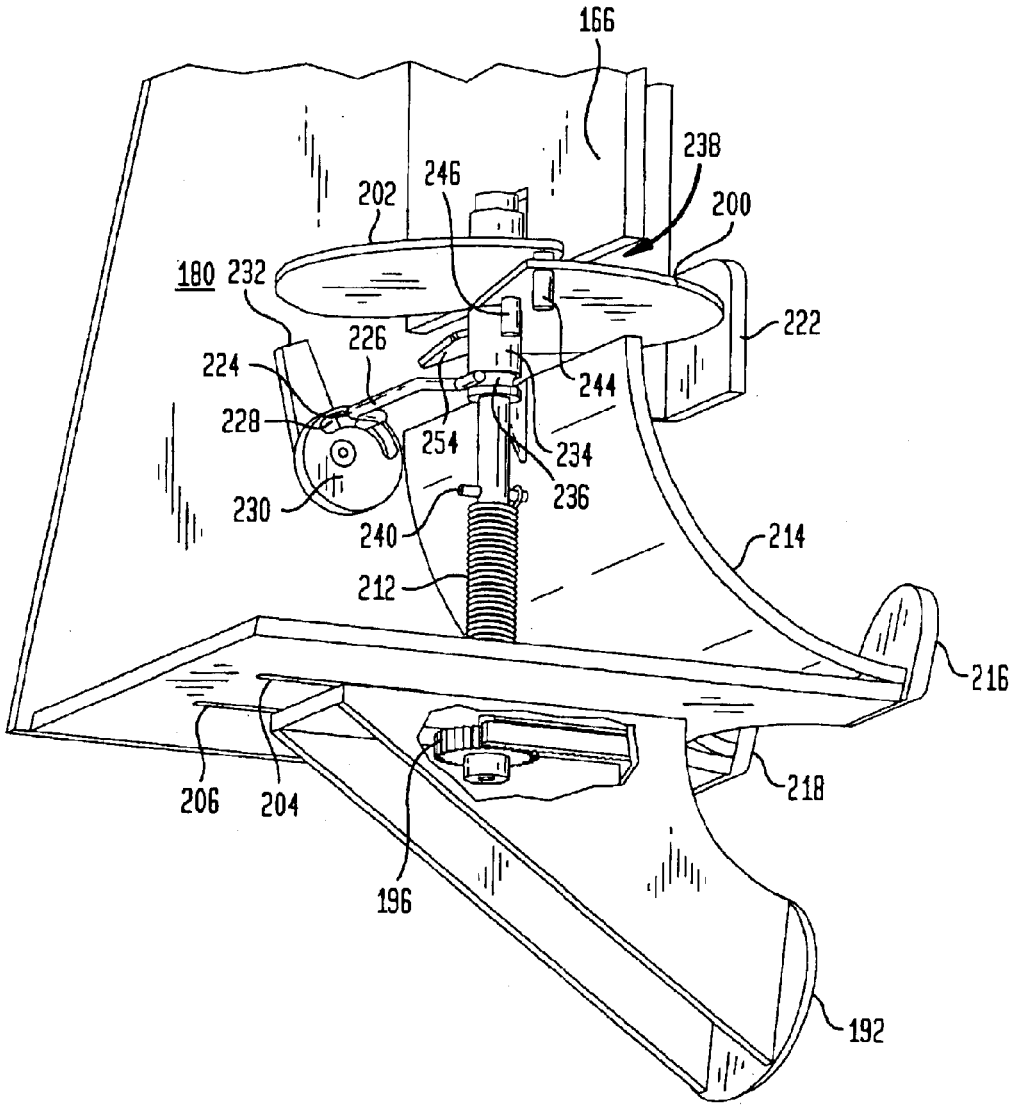
FIG. 10 is a partial view in perspective, partially cut away of the napkin dispenser of FIG. 9 illustrating various parts as seen generally from the left side thereof.
Figure 11:
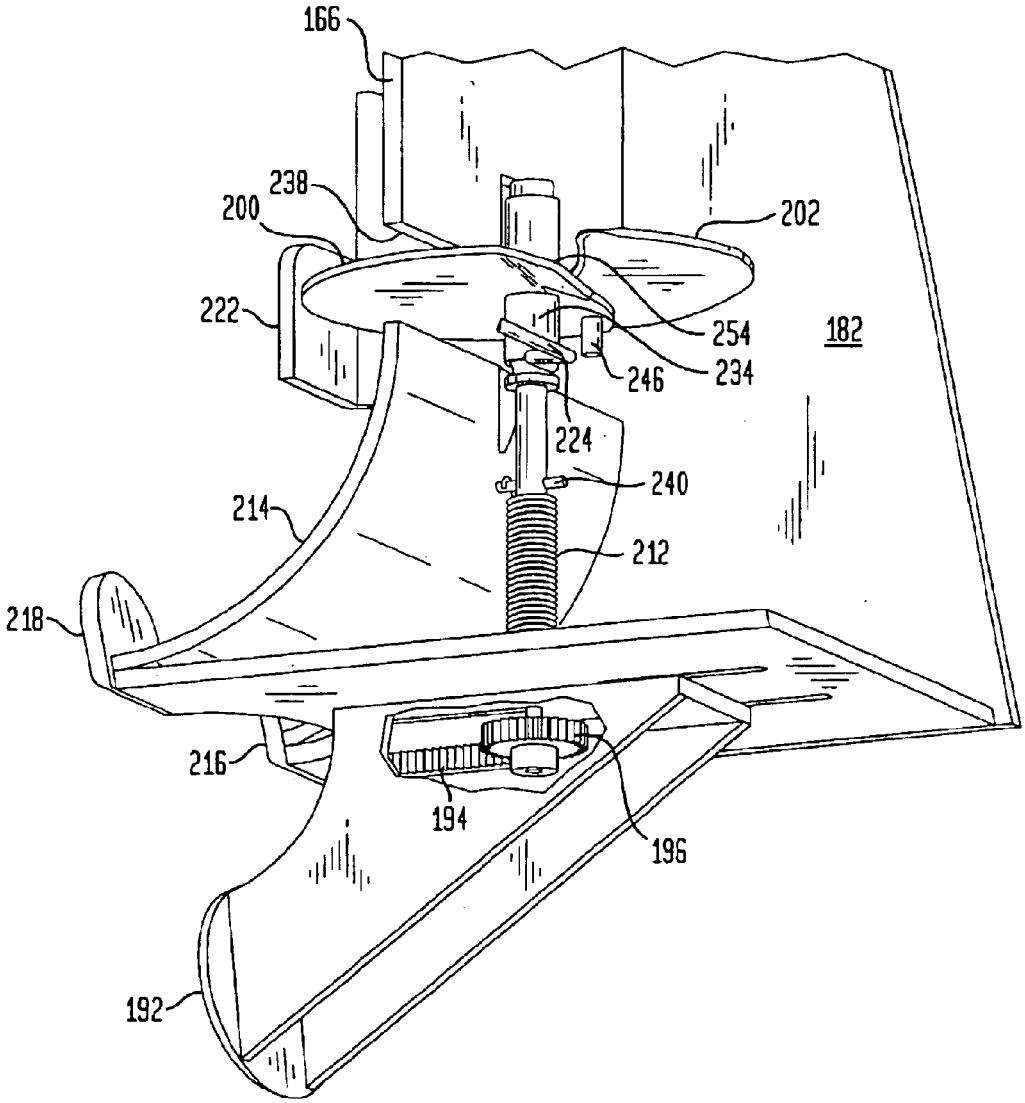
FIG. 11 is a partial view in perspective of a napkin dispenser of FIG. 9, showing various parts as seen generally from the right side thereof.
Figure 12:
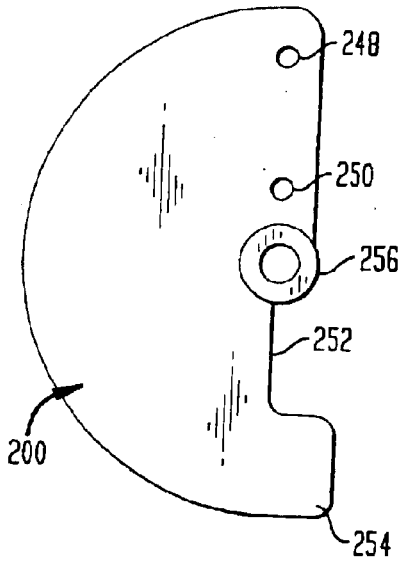
FIG. 12 is a plan view showing the support shutter of the napkin dispenser of FIG. 9.
Figure 13:
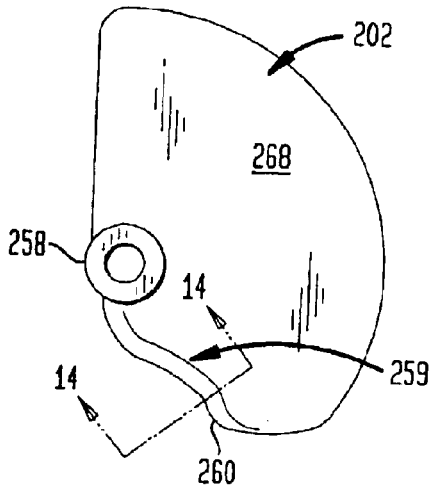
FIG. 13 is a plan view showing the metering shutter of the napkin dispenser of FIG. 9.

Operation of the inventive napkin dispenser 10 is illustrated in FIGS. 6–8. A stack of napkins 128 is disposed in napkin dispenser 10 as shown in FIG. 6. Stack 128 may consist of napkins of the type shown in FIGS. 5A through 5D and is supported on support shutter 54 which is hinged to housing 12 by way of its backward hinged portion 130. Napkin storage magazine 16 is preferably inclined as shown in FIGS. 6–8 at an angle 132 of from about 8° to about 15° with respect to a vertical indicated at 134. Typically the vertical would be parallel to the wall upon which the napkin dispenser is mounted.

In the rest position shown in FIG. 6 support shutter 54 supports the napkin stack in a closed position and is locked in that position by way of cam 56 which rides in slot 58 of the metering lever 50. Metering lever 50 is pivotally mounted about axle 66 as described above. The metering lever 50 is optionally urged towards the rest position shown in FIG. 6 by a spring 64 which may be attached to the metering shutter or the metering lever as shown in the diagram. As noted above the position of lever 50 and thus metering shutter 52 may be adjusted by way of bowed axle 66 simply by turning handle 80 to achieve the desired gap 136 between support shutter 54 and metering shutter 52. As can be seen in FIGS. 6–8 shutters 52 and 54 are generally planar although arcuate in shape. Gap 136 is of predetermined dimension so that when the metering shutter penetrates the stack of napkins a pre-determined number of napkins is segregated from the remainder of the stack as will be appreciated from FIGS. 7 and 8. As lever 50 is pressed downwardly as shown in FIG. 7 the pivotally mounted lever rotates clockwise such that metering shutter 52 intrudes through slot 122 and also penetrates stack 128 as shown in FIG. 7. Since gap 136 corresponds to the thickness of a pre-determined number of napkins these napkins indicated generally at 138 are segregated from the remainder of the stack. As metering shutter 52 advances it is also operative to support the remainder of stack 128. It should be noted that the continuous surfaces such as surface 116 are facing wall 18 so that when the metering shutter penetrates it does not separate panels of a particular napkin. So also as the metering lever rotates clockwise as shown in FIG. 7 lever 50 advances along a cam surface 140 of cam 56 which is configured to urge support shutter 54 to a closed position during early stages of advancing the metering shutter.

When metering lever 50 advances to a sufficient degree, as shown in FIG. 8, cam surface 140 is configured to allow support shutter 54 to open like a trap door and release segregated napkins 138 from the dispenser. Thus, the inventive napkin dispenser segregates a pre-determined number of napkins by way of metering shutter 52 which is operative to support stack 128 and then dispenses segregated napkins 138 by way of opening the trap door or support shutter 54. The napkins then fall into chute 48 and are held in place by retainers 94,96 until grasped by a user of the dispenser.

Following dispensing of the napkins, handle 50 is released by a user and spring 64 urges the napkin dispenser back to the position indicated in FIG. 6. The weight and geometry of the metering member also favors this position.

It will be appreciated by one of skill in the art that various features are present to facilitate smooth operation of the device. For example, support shutter 54 is hinged below its center line 55 such that the trap door will fall away from the metering member 52 when the trap door opens, that is so the gap between the metering member and the support member at its hinged portion will not decrease and tend to bind a napkin in place. So also, slot 122 is substantially shorter than the dispensing length of the folded napkins so that the metering shutter 52 will not draw napkins through the slot as it travels backwardly and jam the device.

Typically the napkin magazine is inclined so as to accommodate the stack of napkins at an angle of from about 8° to about 15° with respect to a vertical as shown in the diagrams. From about 10° to about 12° with respect to the vertical is typical. There is also preferably provided a plurality of ridges 19 which operate to frictionally engage the stack of napkins and distribute its weight to the back wall of the dispenser. It is likewise possible to provide support ridges at other locations within napkin magazine 16 in order to appropriately distribute the weight of the napkin. The moveable shutter used to meter the napkins is in the embodiment shown in FIGS. 6–8, is an arcuate plate. In some embodiments it is also desirable to provide the metering plate with a blunted knife edge portion adapted to penetrate the stack of napkins to be dispensed as discussed in more detail below.

While the napkin dispenser may be provided with any suitable means for biasing the moveable shutter to the closed position, this may be done simply by employing suitable geometry and materials for the metering lever and metering shutter such that gravity will perform this function, or if so desired, one may supply biasing springs as shown in the Figures above. In general, a metering lever is affixed to a metering plate which is generally perpendicular to the metering handle. These pieces may be integrally formed as by way of injection molding and so forth, or may be fabricated in separate pieces. In general the inventive dispenser may be made from any suitable material such as metal or plastic with plastic being preferred for most parts.

Inasmuch as the inventive napkin dispenser may be used in a variety of applications, it is desirable to include means for adjusting the distance between the metering plate and the support plate such that the number of napkins dispensed in a dispensing operation may be varied. This is accomplished in the embodiment described in connection with FIGS. 1–4 and 6–8 by way of a bowed or offset axle about which the metering lever is pivotally mounted. The support shutter is in general freely rotating and driven by the cam member. Due to its configuration, it will naturally tend to rotate downwardly unless locked into place by way of the cam member. Typically, the device is configured such that the cam member locks the support shutter in a closed position between dispensing operations. The cam member may likewise include means for limiting the rotation of the metering member in the direction opposite the dispensing directions. For example, this may be accomplished by way of a pin in hole 60 if so desired as noted above.

By way of summary of the foregoing, there is thus provided in accordance with a first embodiment of the present invention a very simple dispenser with only two major moving parts. The dispensing cycle is self clearing so that even if the metering plate should hit a napkin edge—on, the dispenser will typically dispense the napkin in any event. In general, the concept utilizes a separation plate and trap door to dispense napkins. The napkins rest on a locked trap door while a blunted separator goes between the napkins from the back of the cabinet. As the separator nears the front of the cabinet and holds up the stack, the trap door opens allowing the bottom allotment of napkins to fall by gravity to the receiving chute. In this configuration the separation plate is the same piece as the activation handle, so that when the handle is released the trap-door closes and the separator plate retracts to its initial back most position. There is a cam extending from the trap door shaped such that it protrudes to a slot in the activation or lever handle so that the otherwise freely rotating trap door is driven by the activation handle. The trap door is also locked in an upward position when the activation handle is not depressed. This keeps the weight of the stack from inadvertently causing the trap door to open. The hole in the back wall is big enough for the separator plate to rotate through, yet has two walls that extend to the floor. These keep napkins from being drawn back into the mechanism on the return stroke.

In FIGS. 9–17 there is shown yet another embodiment of a napkin dispenser constructed in accordance with the present invention. Briefly, in this embodiment, a sideways sweeping motion is utilized to penetrate the stack. The working mechanism consists of two half disks, approximately 180° apart and axially spaced upon a rotatable shaft. The upper disk is fixed to the rotatable shaft and the bottom or support disk is able to freely slide along the shaft. The top disk has two pins extending downward that fit into holes in the lower disk so the lower disk is driven by the upper disk. The lower disk can be raised or lowered on the shaft relative to the upper disk by means of a linkage and adjustment lever. The shaft is centered between small bearings and is rotated by a gear which is driven by a rack on an activation push bar. A spring returns the shaft to the starting rotation. The push bar slides in a linear path.

The stack of napkins sits in the cabinet similar to the embodiment of FIG. 1 and following while the napkins rest on the lower disk which protrudes more than half way into the napkin magazine. Because the disk protrudes in so far, no other lips or shelves are needed to hold the napkins, which reduces dependence on napkin tolerance. The cabinet should be able to tolerate napkins that are as much as ½ inch out of spec. The push bar is pressed and the rack and pinion gear rotate the shaft causing the upper disk and attached lower disk to rotate concurrently as one unit. The upper (metering) disk has a blunted knife edge on a spiral shape. The spiral shape causes the metering disk to contact the napkins at the center and propagate the segregation action to the outside. The gradual insertion of the disk affords the napkin more time to be directed up or down. The space between the upper and lower disk can be set to correspond to the desired number of napkins. The upper disk is held in place while the lower disk can be raised or lowered. The disks are rotated so the napkins that are held by the lower disk fall out of the cabinet into the receiving chute while the upper disk rotates into place to hold up the stack. It is one seamless and smooth movement. When the push bar is released a spring returns the push bar and disk to the original position and the stack of napkins lowers to rest on the bottom disk again. Interestingly enough the motion of the disks work equally well if they turn 180° and return or if they proceed a full 360° in the forward direction. This facilitates fully automatic operation by simple addition of a motor and another gear. There could be hand sensing, push buttons, or cash register controls to control the dispenser. Particular features are better appreciated by considering FIGS. 9–17 in more detail.

Referring to FIGS. 9–17, a napkin dispenser 160 includes a housing 162 defining a storage magazine 164 for receiving a stack of napkins. The storage magazine has a back wall 166 provided with a plurality of ridges 168 thereon for frictionally engaging a stack of napkins and transferring some of the weight of the napkins to the housing. There is further provided a door 170 with closure tabs 172, 174. These closure tabs cooperate with closure tabs 176 and 178 which may be magnetic if so desired as well as buckles 188 and 190 to close the napkin magazine during use. The housing further includes a sidewall 180 and a sidewall 182 as well as a top 184.

A working mechanism 186 generally includes a slideably mounted push bar 192 which includes a rack 194 positioned to engage a gear 196 mounted upon a rotatable shaft 198. On the shaft there is provided a support shutter 200 as well as a metering shutter 202.

Push bar 192 is provided with slots 204, 206 through which retaining bolts 208 and 210 protrude in order to secure the push bar to housing 162. There is further provided a mainspring 212 about shaft 198 which biases shaft 198 and thus the various shutters to a rest position as discussed further below.

The housing further includes a chute 214 as well as napkin retaining tabs 216, 218, 220 and 222. There is further provided a wire round 224 having a generally bowed or offset profile mounted about its central portion 226 in a support member (not shown) for adjusting the height of support disk 200 on shaft 198. The wire round is mounted in an eccentric slot 228 in a disk 230 attached to an adjustment lever 232. As the adjustment lever 232 is rotated the wire round, due to its offset shape will force collar 234 upwardly or downwardly upon the shaft and thus adjust the distance of support shutter 200 and metering shutter 202. In this way, one may adjust the number of napkins that are dispensed upon pressing push bar 192. That is to say, wire round 224 engages a slot 236 in collar 234 at its end portion and thereby can raise or lower disk 200. It should further be appreciated from the various diagrams that there is defined in the housing a gap 238 between back wall 166 of storage magazine 164 and chute 214 of the dispenser through which the support shutter and the metering shutter rotate. It will further be seen that spring 212 is engaged on shaft 198 by a pin 240 and is secured to the housing floor by a bolt 242.

Support shutter 200 is coupled to co-rotate with metering shutter 202 by way of pins 244,246 through holes 248 and 250 respectively which are also received in corresponding recesses in metering shutter 202. Support shutter 200 includes a slot 252 as well as a downwardly directed trailing portion 254. The support shutter is generally semi-circular disk-shaped and is mounted about shaft 198 at its central portion 256. Metering shutter 202 is also generally semi-circular disk-shaped and is likewise mounted about shaft 198 about its central portion 258. The metering shutter includes a leading edge 259 which is generally configured as, a blunted knife edge shown schematically in FIG. 14 in order to penetrate a stack of napkins. The metering shutter generally includes about it leading edge 259 a spiral shape (increasing radius) so that the disk will gradually penetrate the stack as noted above. In general as can be seen from the diagrams the metering shutter and the support shutter are offset laterally by 180° and offset axially by a distance corresponding to a pre-determined number of napkins to be dispensed as will be further appreciated by reference to FIGS. 16 and 17.

Figure 14:
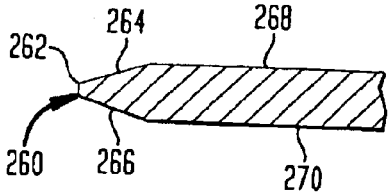
FIG. 14 is an enlarged partial view along line 14 of the metering shutter of FIG. 13 illustrating the blunted knife edge which engages the stack of napkins.
Figure 15:
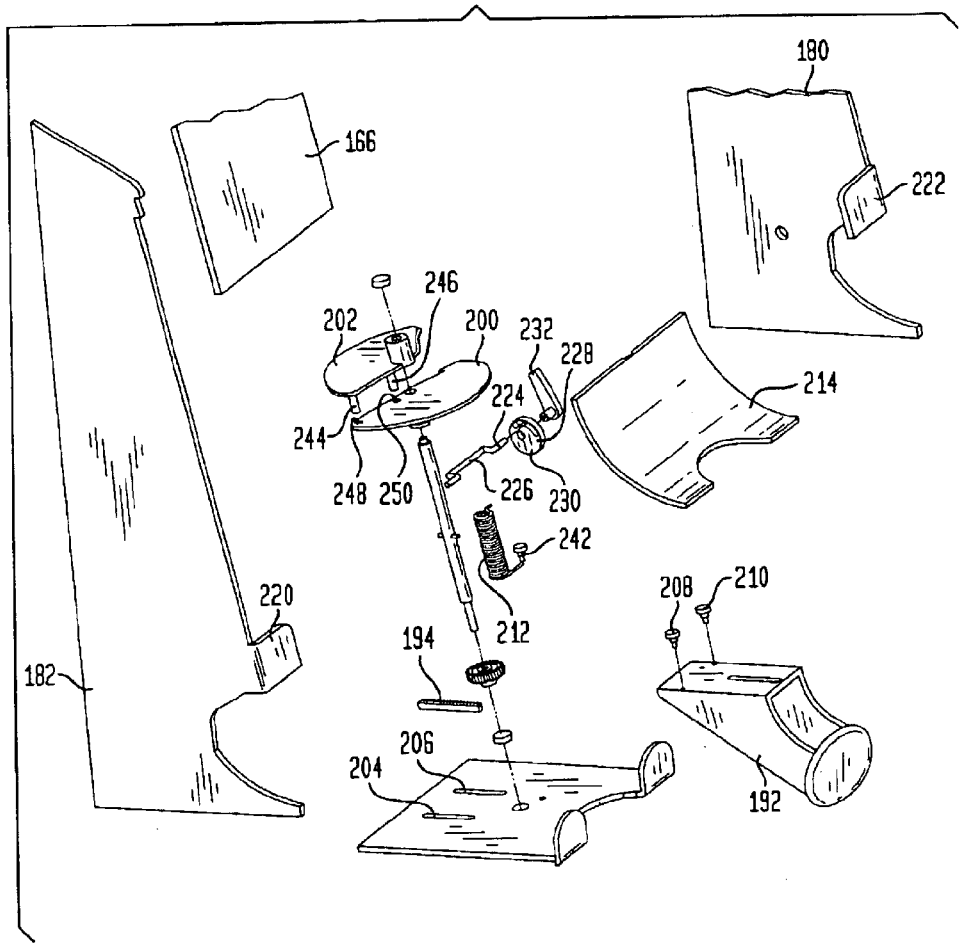
FIG. 15 is an exploded partial view showing various parts in perspective of the napkin dispenser of FIG. 9.

Before turning to that discussion, however, it should be noted that a blunted knife edge is generally desirable when using a planar member for penetrating a stack of napkins to be dispensed in accordance with the present invention. FIG. 14 is an enlarged partial view in elevation of metering shutter 202 along line 14—14 of FIG. 13. Leading edge 260 of metering shutter 202 has a flat portion 262 for penetrating a stack of napkins adjacent a pair of inclined portions 264 and 266 which extend from the blunted edge to the upper surface 268 and the lower surface 270 of metering shutter 202 respectively. With this shape, the shutter tends not to snag or cut the napkins.

Figure 16:
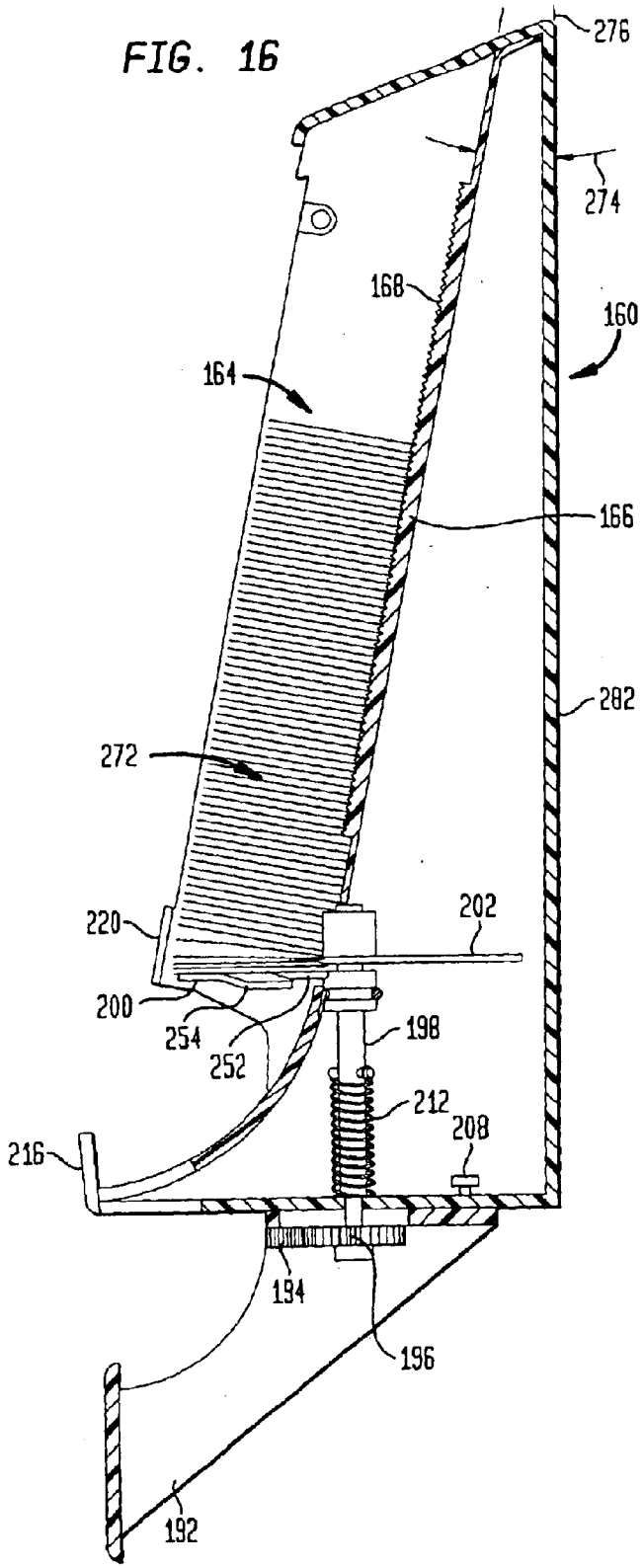
FIGS. 16 and 17 are views in elevation and section along the center line of the napkin dispenser of FIG. 9 as seen from the right side, schematically illustrating operation of the dispenser.
Figure 17:
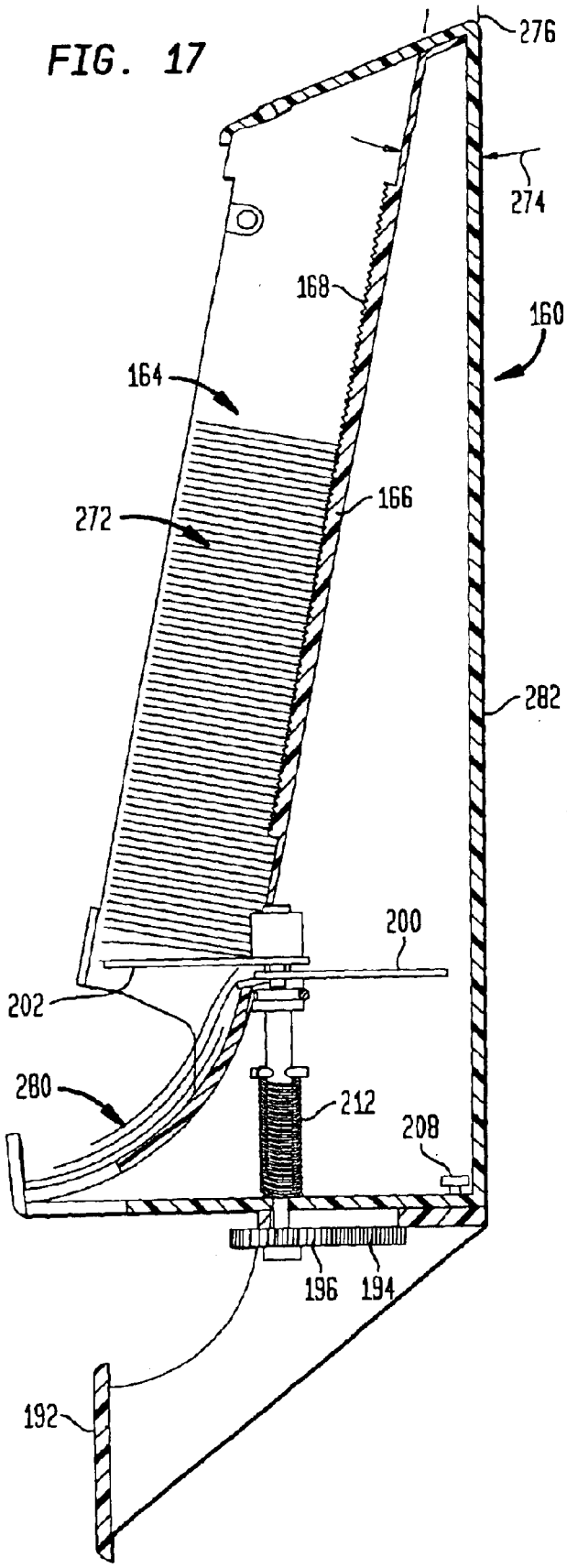

There is shown in FIGS. 16 and 17 a schematic diagram of the napkin dispenser of this embodiment dispensing a napkin stack 272 comprising a plurality of folded napkins as are shown in FIGS. 5A through 5D above. The napkins are disposed in magazine 164 in an inclined manner as shown. Here again the napkin stack makes an angle 274 with a vertical 276 of from about 8° to about 15°. Typically the vertical 276 would simply be a wall upon which the napkin dispenser is mounted. The napkin stack 272 is frictionally engaged by ridges 168 on back wall 166 of the magazine in order to transfer some of the weight of the napkin to the housing. It will be appreciated that the angle of inclination of the stack also concentrates the gravitational force along the wall making it easier for the metering shutter to penetrate the stack of napkins.

FIG. 16 depicts the inventive napkin dispenser in a closed position wherein metering member 202 is disposed behind the back wall 166 of the napkin magazine and the support shutter 200 supports stack 272. The napkin dispenser is biased to this position by way of spring 212 which is coupled to the shaft 198 and the floor of the housing. When the push bar 192 is operated, that is pushed to the right by a user, the napkin dispenser working mechanism rotates by action of the rack and gear upon shaft 198. The metering shutter 202 penetrates the stack thus segregating a plurality of napkins 280 from the remainder of the stack and operates to support the stack while support shutter 200 rotates away from the stack (FIG. 17) and in between the back wall and an outer wall 282.

It should be noted that here again the napkins are arranged so that their continuous surfaces such as surface 116 are adjacent wall 166 and are first to be penetrated with edge 260 of metering shutter 202. It is further noted that support shutter 200 is provided with a slot 252 opposite the leading edge 260 of metering shutter 202 to facilitate penetration of the stack of the metering member. That is to say, slot 252 provides an unsupported edge portion of the napkin stack which is less resistant to penetration than it would otherwise be.

When the support member rotates back to the rest position wherein it is in its closed position, the napkins will advance by gravity to the support shutter and the process may be repeated for another operation. The number of napkins which are dispensed depends upon the axial spacing between metering shutter 202 and the support shutter 200. Typically one simply lowers the support shutter 200 to increase the distance from the upper, metering shutter 202. It should also be noted that inasmuch as the napkin dispenser 160 operates by way of rotation it is advantageous to have a downwardly disposed trailing edge 254 to allow the napkins to smoothly fall away from support plate 200 as it rotates from its rest or closed position through gap 238 in the housing to its rearward open position.

There is shown in FIGS. 18 through 27 yet another napkin dispenser 310 including a housing generally indicated at 312 which defines a storage chamber or napkin magazine 314. There is also provided a door 316 mounted on a pair of hinges 326,328. Door 316 is also provided with closure tabs 322,324 which cooperate with buckles 318,320 to secure the door in a closed position. Any suitable closure means may be used to secure door 316 to the remainder of the housing.

Door 316 may be provided with sights 330,332 in the form of elongated slots so that a user is able to monitor the level of the stack of paper napkins inside of the dispenser. There is provided at the lower extremity of napkin dispenser 310 a catch basket 334 which includes retaining members 336,338 as well as a catch plate 340.

Figure 18:
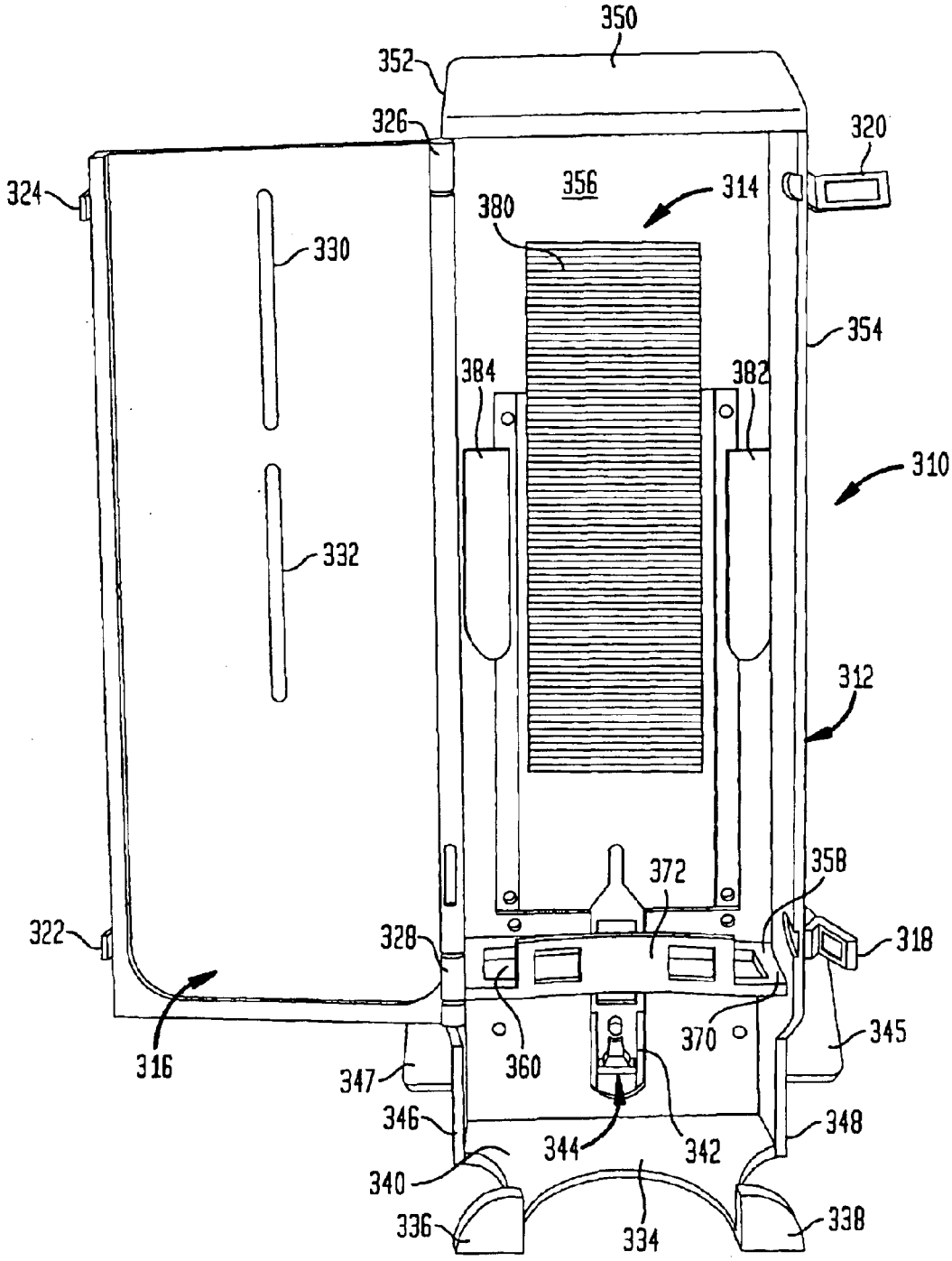
FIG. 18 is a front view in elevation of another napkin dispenser of the present invention wherein the door is open to expose the storage magazine.
Figure 19:
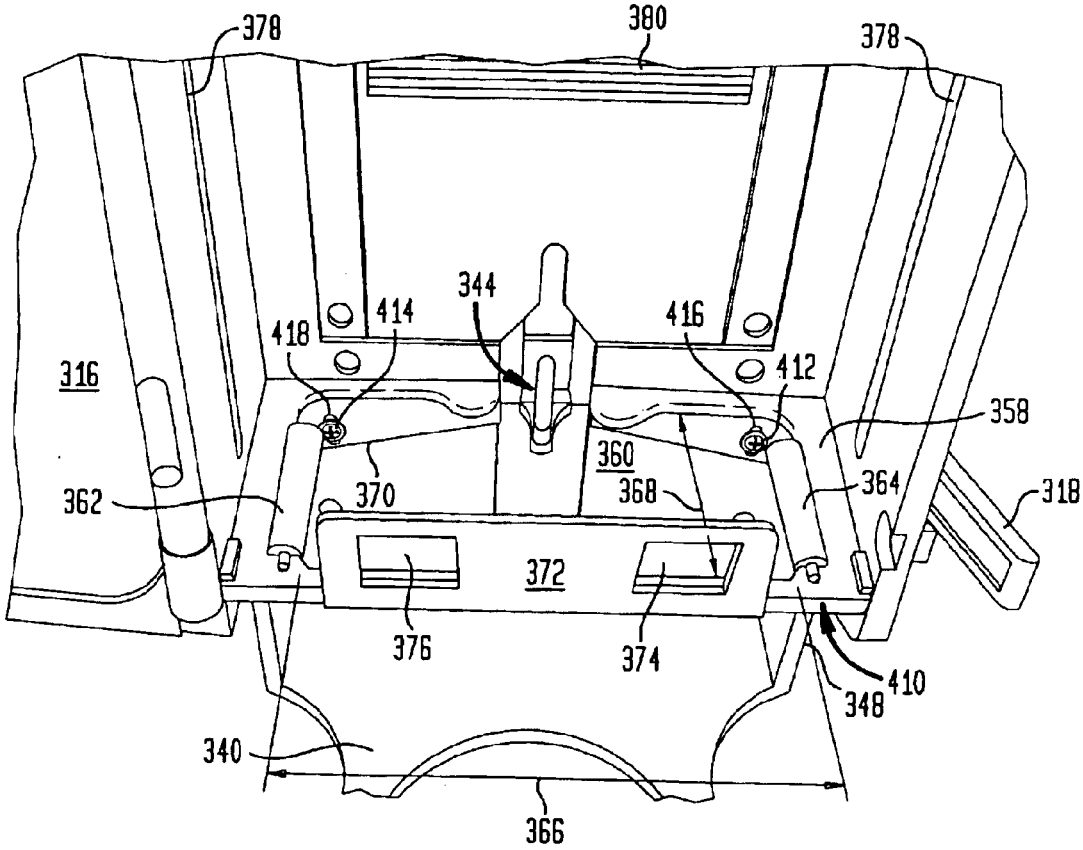
FIG. 19 is a partial view in perspective showing the dispensing aperture and various parts of the napkin dispenser of FIG. 18.
Figure 20:
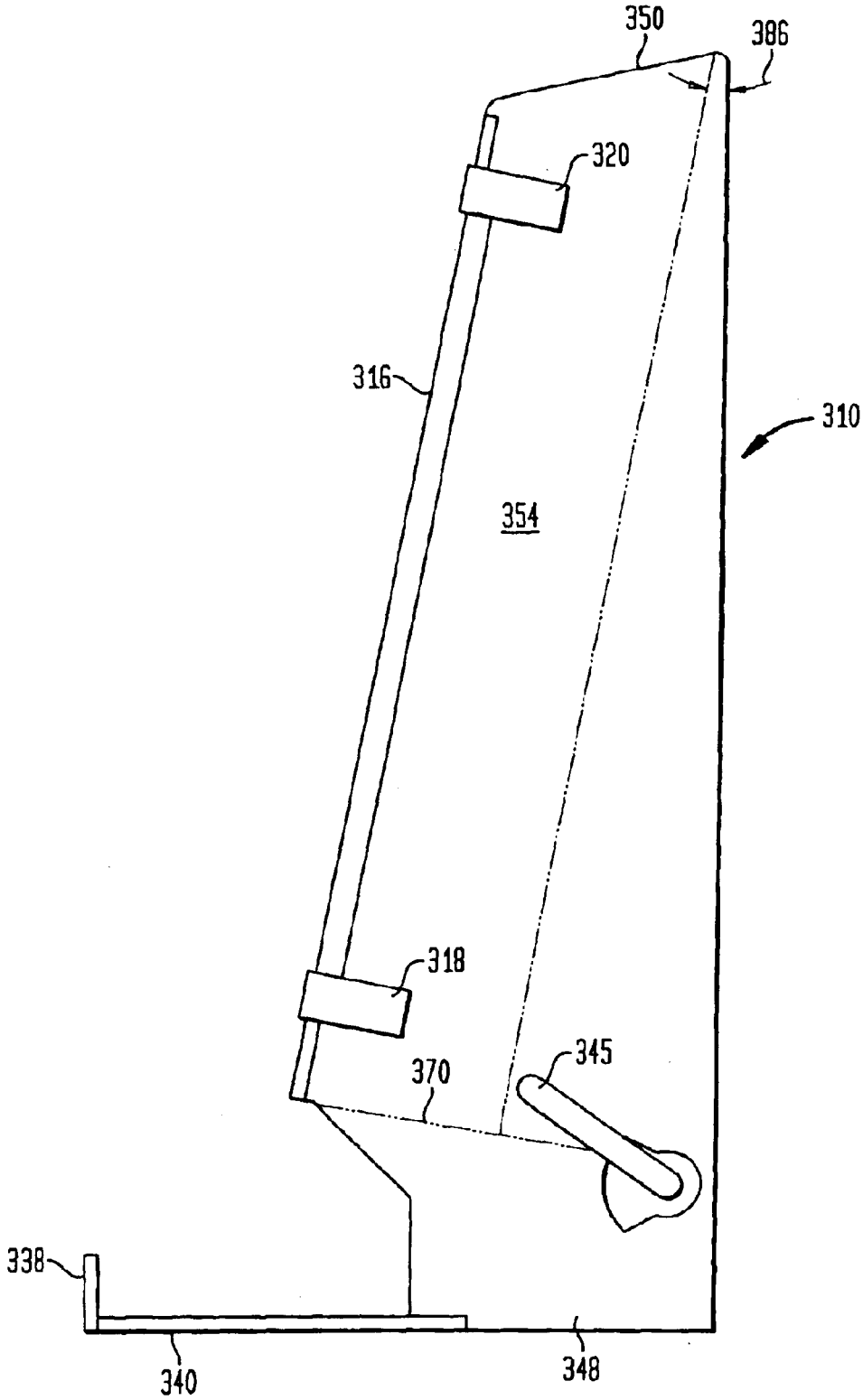
FIG. 20 is a side view in elevation of the napkin dispenser of FIGS. 18 and 19 as seen from the right side.
Figure 28:
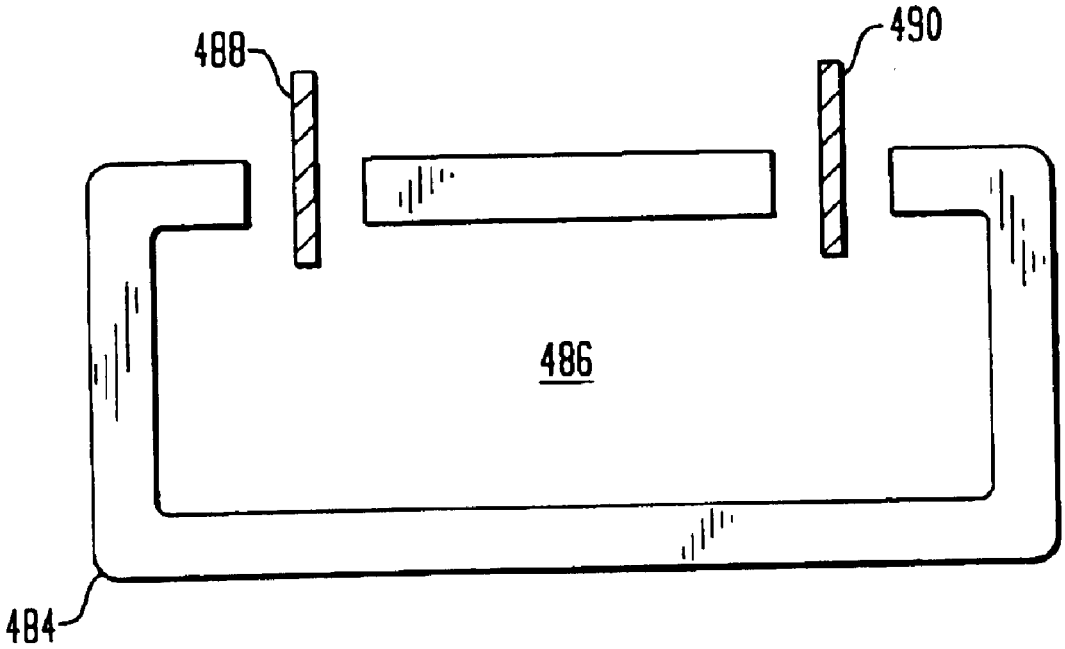
FIG. 28 is a schematic illustration of still yet another mode of practicing the present invention.

It can be seen FIGS. 18 through 20 in particular that the napkin dispenser also defines a slot 342 to allow for the downward travel of a metering carriage 344, the significance of which will become apparent from the discussion which follows. A dispensing aperture 360 is generally C-shaped in accordance with the embodiment of the invention, as is seen in FIG. 19. The term C-shaped merely refers to the fact that the dispensing aperture has a discontinuous perimeter, typically a discontinuous generally rectangular perimeter as is shown in FIGS. 19 and 28.

There is also provided retaining walls 346,348 to help secure the napkins after they are dispensed from the stack.

Napkin dispenser 310 is further provided with a top 350 as well as sidewalls 352 and 354 adjacent backwall 356. Together, top 350, sidewall 352, sidewall 354, backwall 356 and door 316 define a chamber for receiving a stack of folded napkins. At the lower portion of the chamber there is provided a supporting surface 358 about dispensing aperture 360. Surface 358 and aperture 360 are generally configured in a "C" shape as noted above and there is optionally provided a pair of rollers 362,364 (FIG. 19) to help facilitate the dispensing of napkins. In a typical embodiment the aperture has a length 366 and a width 368 as indicated in FIG. 19. Length 366 is typically shorter than the corresponding dispensing length (length 118, FIG. 5A) of a folded napkin stacked in dispenser 310 such that the napkin will not pass through aperture 360 until urged to do so by the metering member of the napkin dispenser 310. The dispensing aperture generally has a length of anywhere from about 10% to about 30% shorter than the dispensing length of the folded napkins to be dispensed therethrough and typically from about 15% to about 25% shorter than the dispensing length of the napkins. Generally speaking, support surface 358 is typically planar and defines a dispensing plane 370 about aperture 360. There is also provided a support member 372 for receiving the napkins which is advantageously provided with wedge members 374,376 which are configured to urge the napkin stack towards back wall 356.

Dispenser 310 may be further provided with one or more additional sights, such as sights 378 in the form of elongated slots in order to monitor napkin level; or alternatively and perhaps more desirably door 316 may be made from a transparent or translucent material making such slots unnecessary. There is further provided within chamber 314; specifically on back wall 356 a plurality of ridges 380 as well as a pair of curved support members 382,384.

In general, it is preferred that a napkin dispenser of the present invention utilizes an inclined stack of napkins. That is to say the storage chamber generally arranges the napkin stack having an angle of inclination 386 of from generally about 8° to about 15°, typically about 10 to 12° and in a particularly preferred embodiment about 11°. The angle of inclination serves several functions. For one, the angle will facilitate distribution of the weight of the napkin stack on to back wall 356 so that the force about the dispensing aperture is not unduly great. For another, napkins are dispensed in accordance with the present invention by way of a metering member on metering carriage 344 which penetrates the stack of napkins. It is thus advantageous to incline and urge the napkins towards back wall 356 so that they are more easily grasped and drawn through dispensing aperture 360 as will become apparent from the discussion which follows. Inclining the magazine also makes the napkin dispenser easier to load with napkins. Likewise, it is preferred to use a folded napkin that presents a continuous surface that is free from edges, towards the back of the dispenser.

In this respect, folded napkins as shown in FIGS. 5A through 5D are also employed in connection with the dispenser shown in FIG. 18 and following. It is preferred to orient the napkins so that their continuous surfaces are all arranged on one face of the stack and have the metering member penetrate the stack on that face so that the dispenser operates optimally. In the various embodiments illustrated herein it is preferred to orient the folded napkins of FIGS. 5A through 5D in a stack so that all of the continuous surfaces, such as surfaces 115, 116 are disposed adjacent the back wall of the napkin storage magazine and have the metering member approach through the back wall.

As noted above, the dispensing plane 370 is defined about supporting surface 358 which in turn is the upper portion of support platform 410. Inasmuch as the predetermined number of napkins, for example one, two, four, six or eight napkins at a time, are separated from a stack of napkins by the metering carriage 344, it is desirable to adjust the level of surface 358 with respect to the metering carriage. In this respect there are provided mounting screws 412,414 provided in slots 416,418 to adjust the metering length and thus the number of predetermined number of napkins to be dispensed, the one simply adjusts the height of platform 410 via screws 412 and 414 as can be best seen in FIG. 19.

Figure 21:
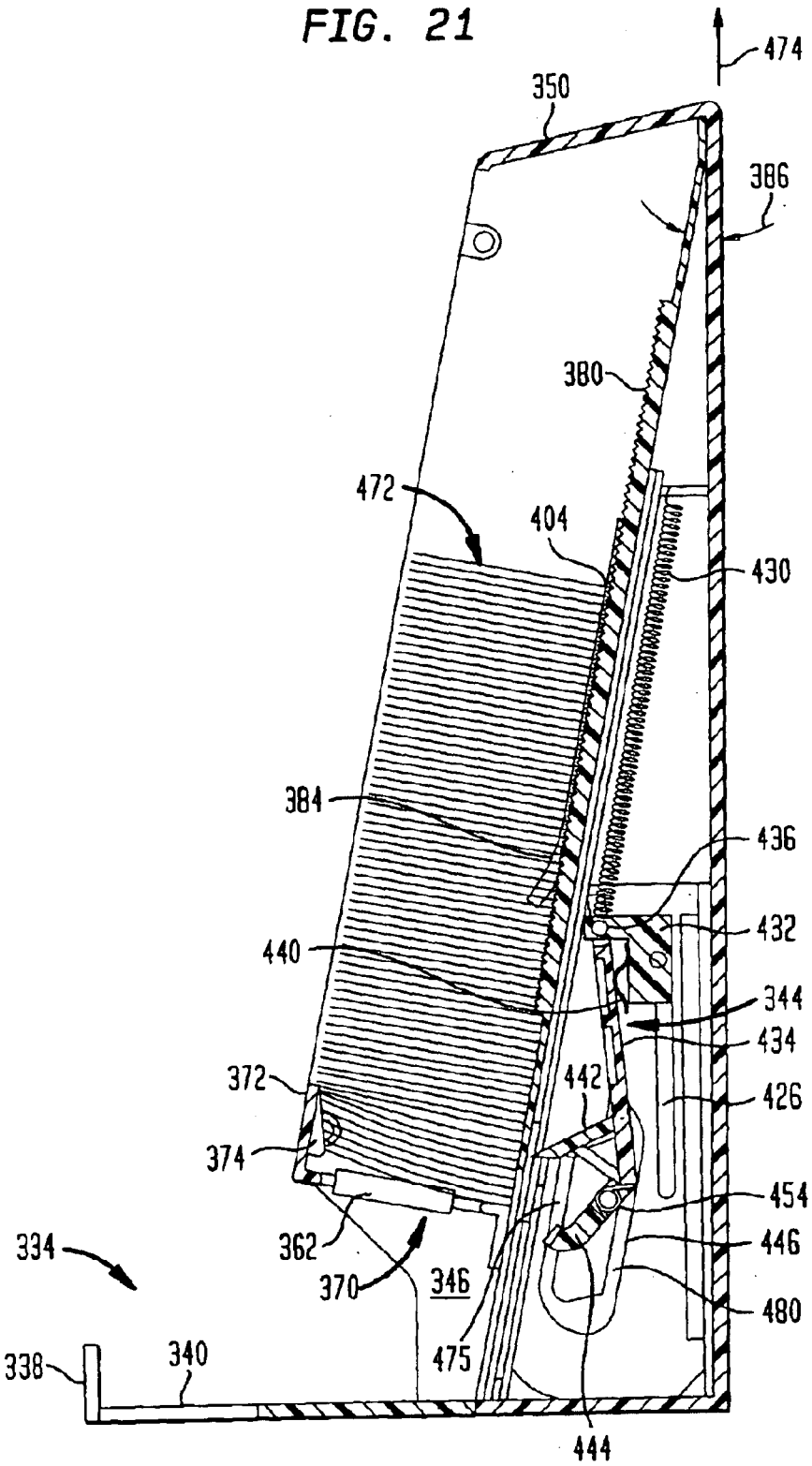
FIGS. 21–24 are sequential side views from the right side, in elevation and section, of the napkin dispenser of FIGS. 18–20 along the centerline of the dispenser illustrating operating of the dispenser.
Figure 22:
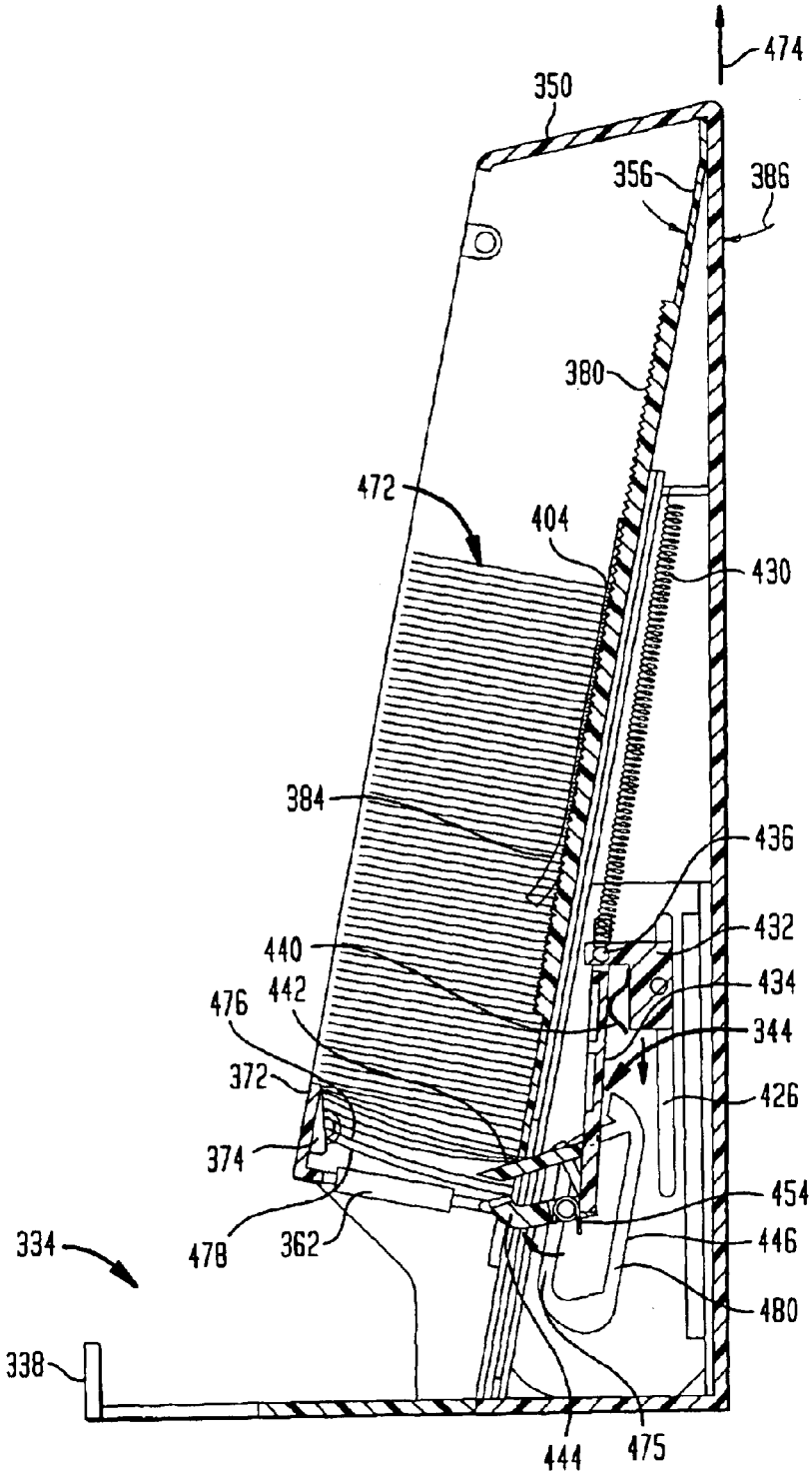
Figure 23:
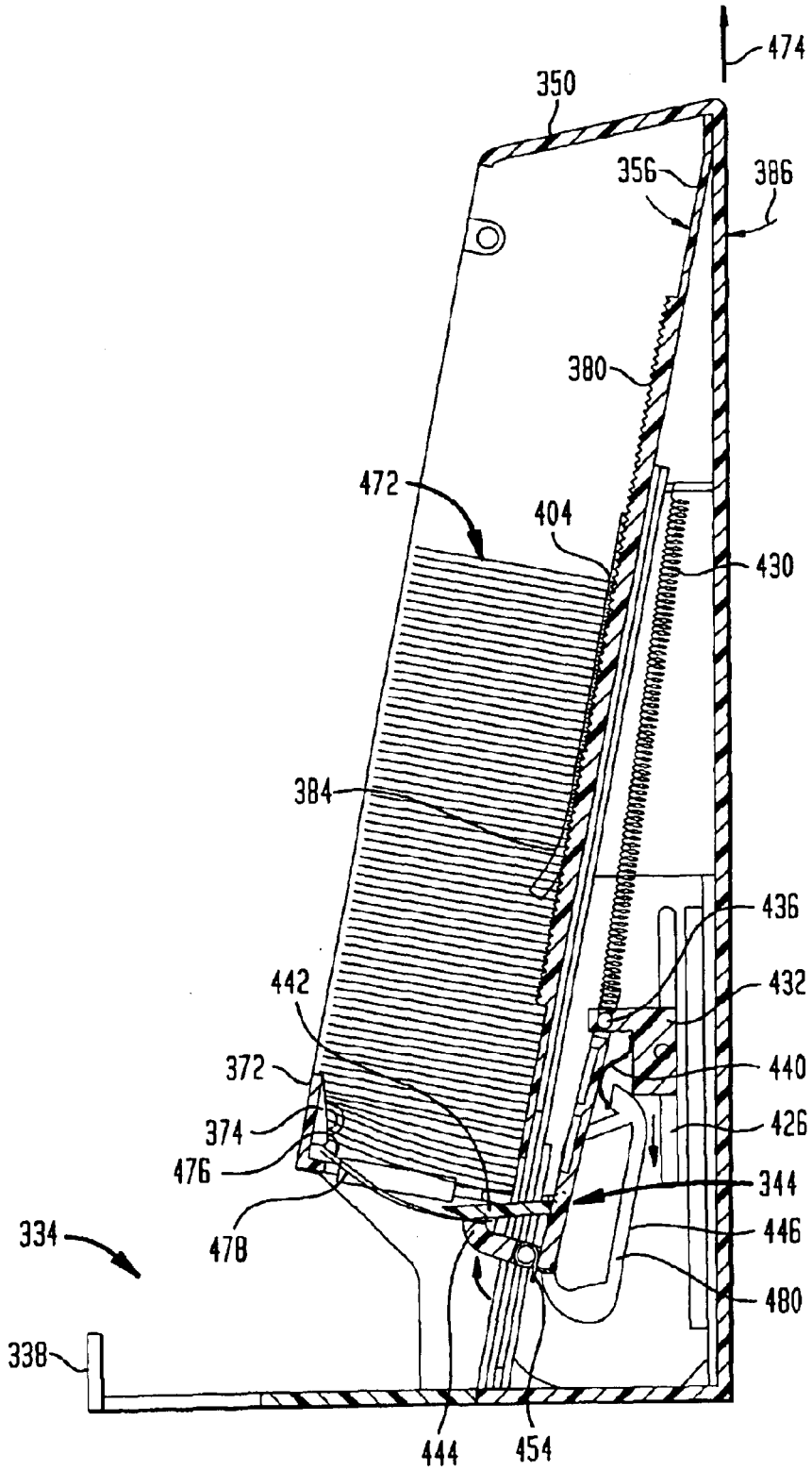
Figure 24:
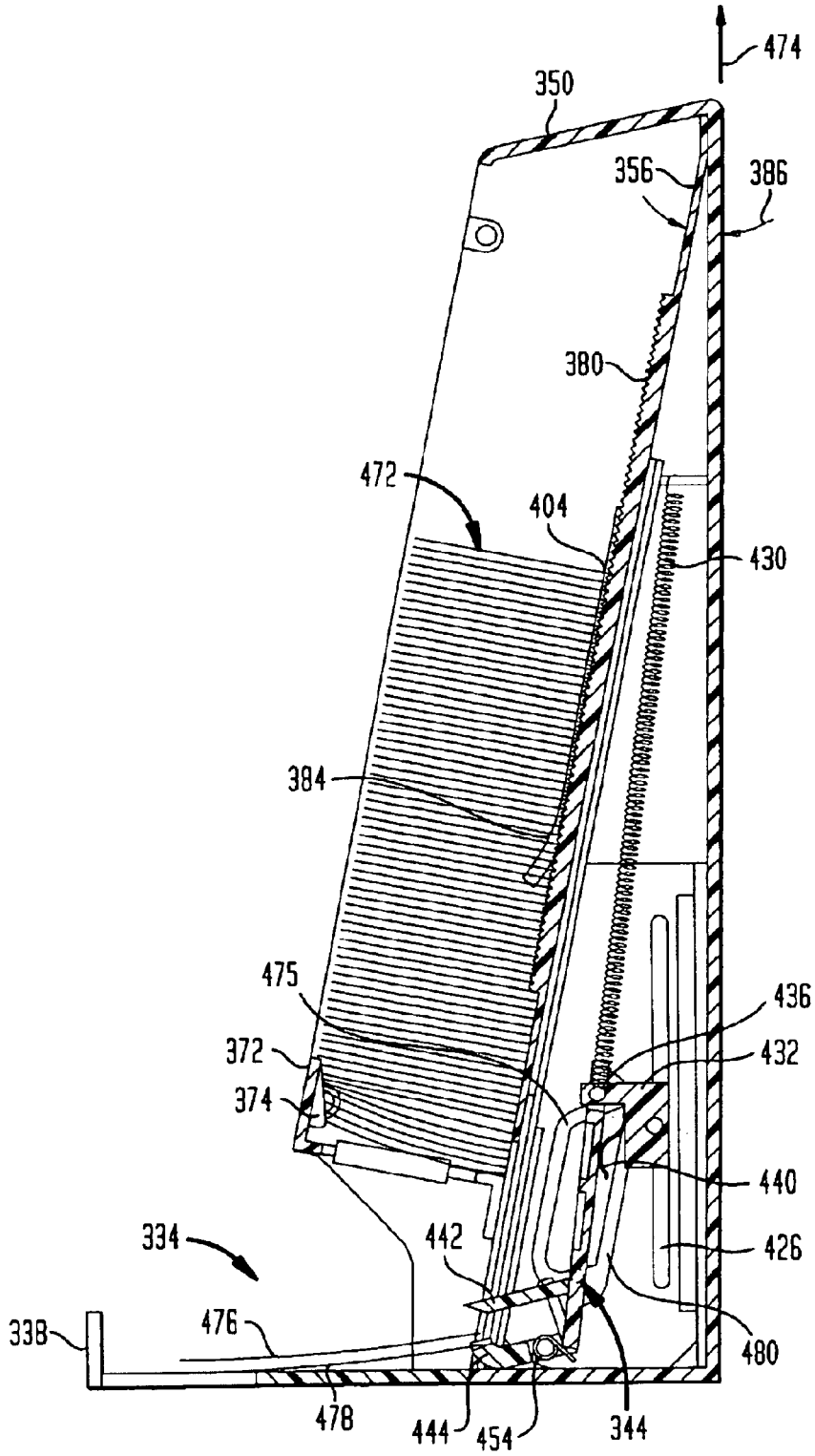
Figure 25:
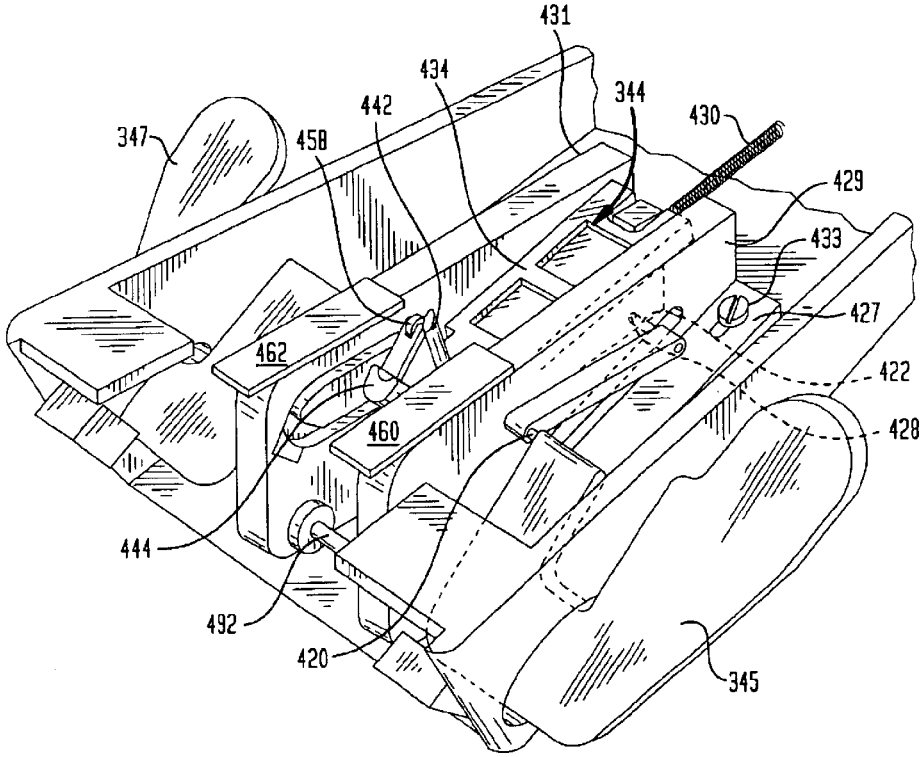
FIG. 25 is a partial view in perspective showing various mountings and mechanical features of the inventive napkin dispenser of FIG. 18 and following.
Figure 26:
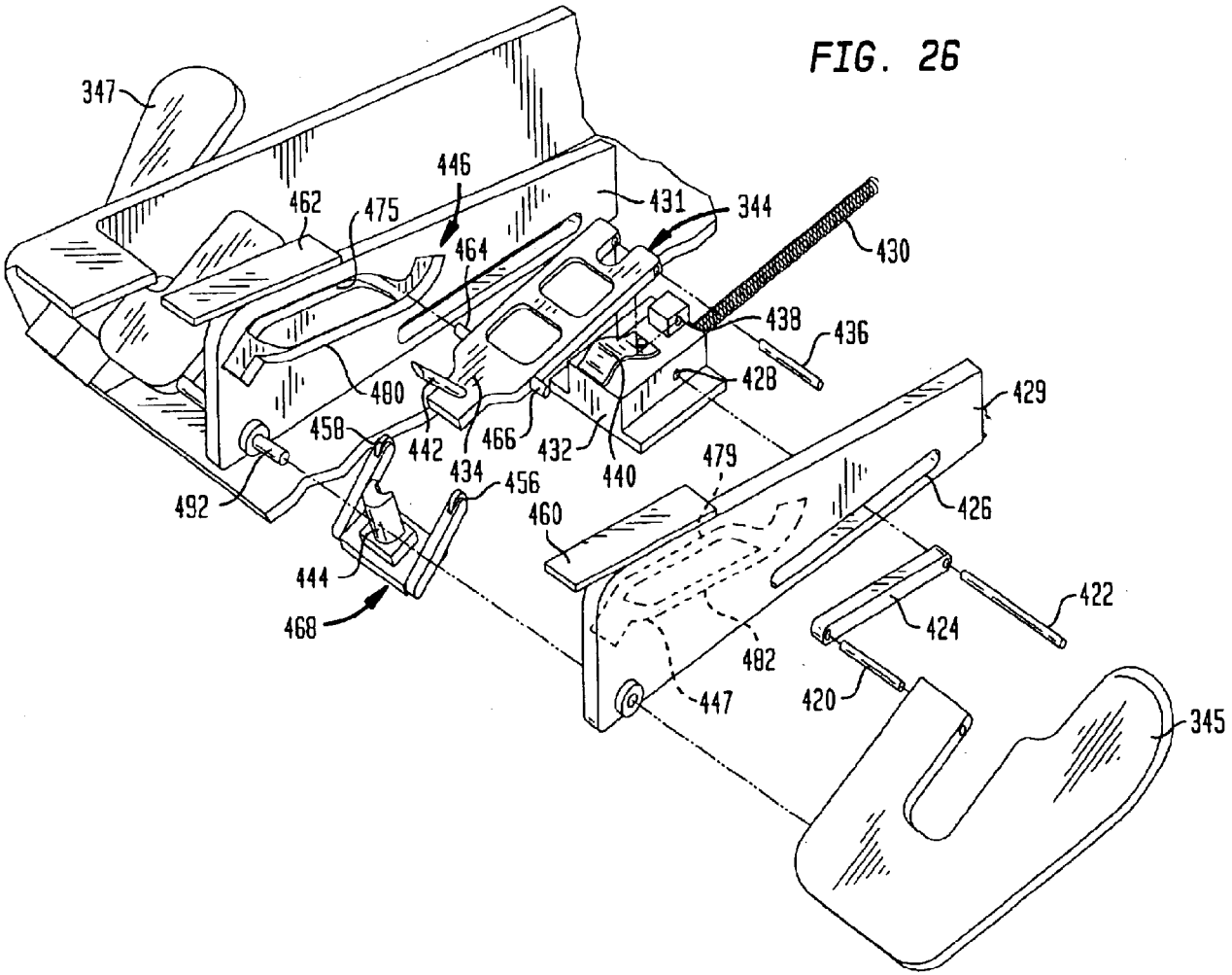
FIG. 26 is an exploded perspective view of the parts shown in FIG. 25.
Figure 27:
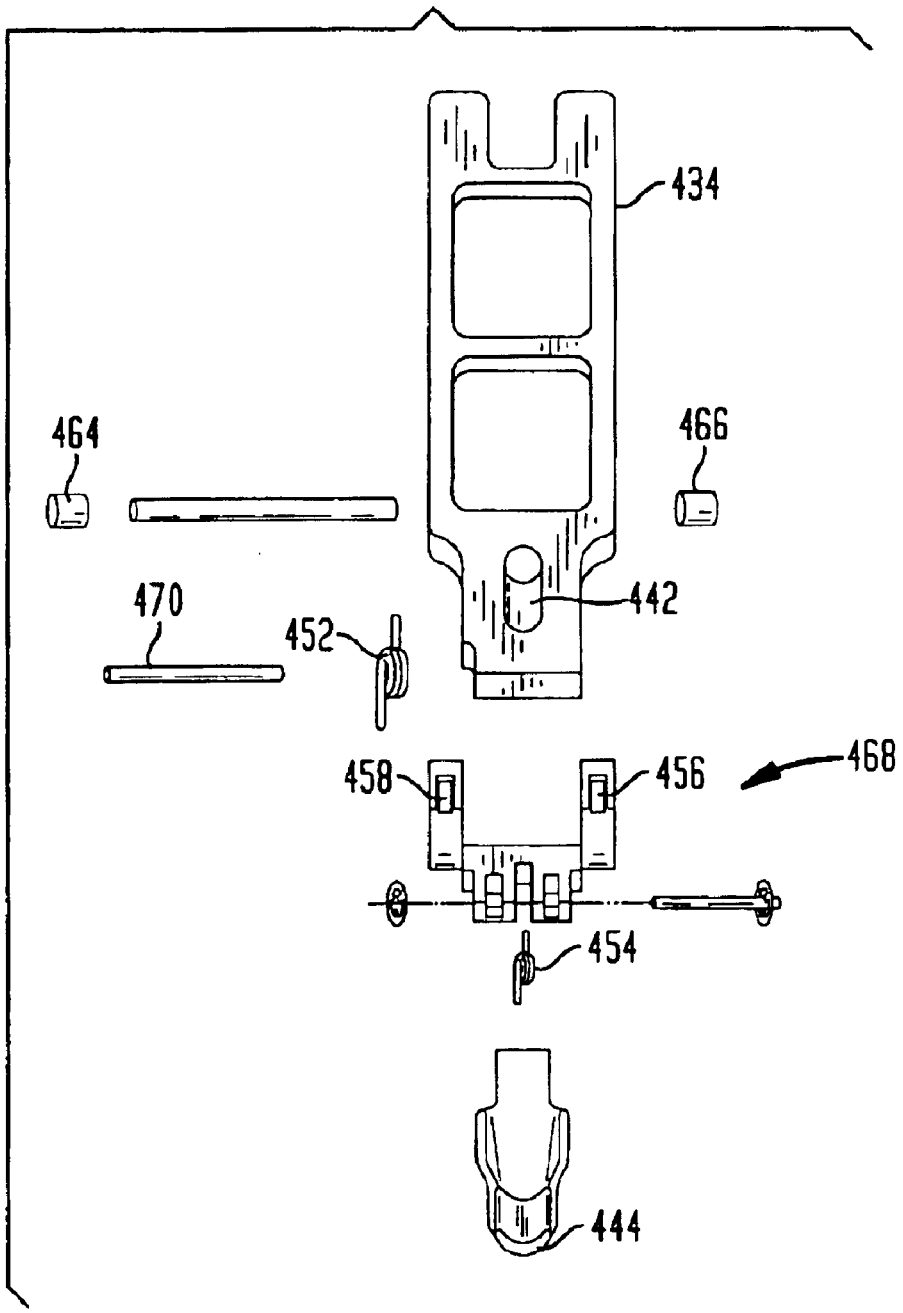
FIG. 27 is an exploded view of selected parts shown in FIGS. 25 and 26.

Operation of the inventive napkin dispenser is perhaps best appreciated by considering FIGS. 21 through 27. These figures illustrate sequentially operation of napkin dispenser 310 as the dispensing levers are depressed and metering carriage 344 travels downwardly in a metering stroke and is returned to a rest position by the main biasing spring. In general FIG. 21 is a diagram in elevation and section of the invented dispenser wherein the metering carriage is disposed upwardly in a rest position whereas FIG. 22 shows the metering carriage segregating two napkins to be dispensed and FIG. 23 shows the metering device displacing two napkins through the dispensing plane. FIG. 24 shows the metering carriage releasing a napkin into the catch basket 334 and FIGS. 25 through 27 show the various mountings and mechanical parts associated with carriage 344. FIG. 25 is a perspective view showing the mechanism of the inventive napkin dispenser, whereas FIGS. 26 and 27 are exploded views thereof. The actual operation as shown in FIGS. 21 through 24 is perhaps better appreciated by first considering the mechanism shown in FIG. 25 and following. There is shown metering lever members 345,347 which are mounted on a shaft 492 and connected via mounting pins, for example, pins 420,422 and mounting bar 424 to the metering carriage 444 via a recess 428 in sled 432 (FIG. 26). Carriage 344 includes member 434 and the various parts shown.

It should be noted that pin 422 goes through a slot 426 in mounting wall 429 which is internal to the napkin dispenser. The mechanism of FIGS. 25–27 is conveniently mounted on a back plate 427 which creates a sub-assembly including the supporting walls and the various reciprocating components. The sub-assembly may be secured to the housing by a plurality of screws such as screw 433. Sled 432 is also biased upwardly by a main biasing spring 430 which urges the metering carriage to an upper rest position as is shown in FIG. 21. Attached to sled 432 is a metering member carrier 434. Metering member carrier 434 is attached to sled 432 via a pin 436 which is received in a recess 438. In between the metering member carrier and sled 432 is a leaf spring 440 to urge member 434 forwardly during a dispensing operation as will be discussed in more detail below. A napkin metering member 442 is carried on member 434 as shown in the various figures particularly in FIGS. 26 and 27. It should be noted that member 442 is fixedly mounted upon member carrier 434 whereas a lower jaw 444 is pivotally mounted on carrier 434. There is also provided in connection with jaw 444 a pair of springs 452 and 454 to bias the opening and closing of the pincers formed by member 442 and jaw 444.

There is additionally provided a pair of rollers 456 and 458. Rollers 456 and 458 which engage the retaining bars 460,462 along the inner surfaces which forces the jaw into the grasping motion seen in FIGS. 21 through 24 as the metering carriage advances in a dispensing stroke.

More particularly the metering member carrier 434 is disposed in a pair of opposed tracks 446,447 in walls 429,431 one track of which is shown as 446 in FIG. 24 and both of which are shown in FIG. 25. The metering member carrier is guided in tracks 446,447 by way of pins 464 and 466.

Operation of napkin holder 310 will be further appreciated by considering the details of yoke assembly 468 which carries jaw 444 as well as spring 454, rollers 456, 458 and is shown in exploded view in FIG. 27 together with metering member carrier 434, spring 452 and a shaft 470 used to pivotally secure yoke assembly 468 to metering member 434, wherein the various angular relationships between parts are biased by springs 452,454 as further discussed below.

FIG. 21 through 24 are views in elevation and section along the centerline of napkin dispenser 310 showing operation of dispenser 310 incorporating the various parts shown in FIGS. 25 through 27 during a dispensing stroke and in rest position (FIG. 21). It is noted that the dispenser is basically symmetrical about the centerline such that only one side need be shown (which is also the case with FIGS. 25 and 26, for example, track 447 is substantially identical to track 446 and mounting wall 431 is identical to mounting wall 429. In FIG. 21, metering carriage 344 is held upwardly by main biasing spring 430 in a rest position, and jaw 444 is based downwardly by spring 452 as shown in FIG. 21.

A stack of napkins 472 is loaded into the dispenser as shown, 1 line schematically indicating 1 folded napkin of the type shown in FIGS. 5A and 5B. The weight of stack 472 is partially borne by back wall 356 because of angle of inclination 386 from the vertical 474 which is typically a wall upon which napkin dispenser 310 is mounted. Ridges 380 project inwardly into chamber 314 and frictionally engage stack 472, also serving to support the weight of stack 472. Likewise, curved support member 382,384 engage the stack and further support its weight.

When either metering lever member 345,347 or both are depressed downwardly by a user, carriage 344 moves downwardly and metering carrier member 434 advances downwardly and toward the stack since pins 464,466 will travel downwardly in the inner portions 475,479 of tracks 446,447. Note that metering member carrier 434 is urged forwardly by leaf spring 440 so that pins 464,466 are in track parts 475,479 during a downward dispensing stroke as is shown in FIG. 22.

It can be seen in FIG. 22, that as the metering member 442 advances downwardly and forwardly in a dispensing stroke, member 442 penetrates stack 472 and segregates a predetermined number of napkins (2 in the example shown) from the remainder of the stack. In the position shown in FIG. 22, rollers 456,458 of yoke 468 engage retaining bars 460 and 462 which operates to compress spring 452 and move yoke 468 and jaw 444 upwardly with respect to metering member 442 as the carriage advances in a dispensing operation as shown in FIG. 22. Jaw 444 is biased toward metering member 442 by spring 454 to grasp two napkins 476,478 to be dispensed. Member 442 and jaw 444 thus act as a pincer mechanism to grasp the napkins to be dispensed. If it is desired to dispense more or fewer napkins in a dispensing stroke, it is convenient to merely change the height of supporting surface 358 by loosening screws 412,414 and adjusting platform 410 by way of the position of the screws in slots 416,418. In this manner, for example, the height above dispensing plane 370 that making member 442 penetrates the stack may be adjusted to correspond, for example, to 2, 4 or 6 folded napkins to be dispensed.

In the view of FIG. 23, spring 452 is fully compressed by the action of the rollers on the retaining bars as metering member 442 travels further downwardly on member 434 and the metering member cooperates with jaw 444 to release napkins 476, 478 from support surface 358 through aperture 360 past dispensing plane 370. Note in this position spring 454 biases closure about the napkins by members 442,444.

In the view of FIG. 24, the metering carriage continues to travel downwardly until rollers 456,458 travel past retaining bars 460 and 462. Spring 452 is thus released, urging jaw 444 downwardly as shown and thereby depositing napkins 476,478 in catch basket 334. The inertia of yoke 468 as it springs downward operates to bias pins 464,466 into rear or outer track portions 480,482 of tracks 446 and 447. The relative positions of FIG. 24 represent the finish of a dispensing stroke, where metering lever 345 is fully depressed. After the dispensing stroke is finished and the lever released, pins 464,466 travel up track portions 480,482 as main biasing spring 430 returns the metering carriage to the rest position of FIG. 21.

The various parts of the inventive napkin dispenser may be made of any suitable material such as metal, plastic and so forth. Preferred for large planar pieces such as door 316 are relatively amorphous resins such as ABS (acrylonitrile-butadiene-styrene) resins, polycarbonate, poly (methylmethacrylate) and other impact modified styrenes, for example, high impact polystyrene (HIPS) which is typically prepared by blending styrene with K-resin (styrene-butadiene copolymer).

Mechanical parts such as members 442,444, sled 432, carrying member 434 and tracks 446,447 are advantageously made from engineering resins such as polyesters, polyacetals, nylons and so forth. Polyacetal, due to its ease of processing and natural lubricity, is a particularly preferred material. Formaldehyde homopolymer (e.g., Delrin® polyacetal) or copolymer (e.g. Celcon® polyacetal) are examples of suitable acetals.

The metering dispenser of the present invention exhibits remarkable consistency with respect to product dispensing. Even an early prototype exhibited the performance characteristics noted in Table 1 below.

TABLE 1

Dispensing Performance Characteristics (early Prototype)

| No. Pulls | Set Quantity | Within Target | Under Target | Over Target |
|---|---|---|---|---|
| 1575 | 2 | 97% | 0 | 3% |
| 579 | 4 | 89% | 1% | 10% |
| 1050 | 6 | 88% | 9% | 3% |

A design as shown in FIGS. 18–27 exhibited the performance characteristics listed in Table 2.

TABLE 2

Dispensing Performance of Napkin Dispenser of FIGS. 18–27

| No. Pulls | Set Quantity | Within Target | Under Target | Over Target |
|---|---|---|---|---|
| 640 | 2 | 99 | 0 | 1 |

Whereas, the invention has been described in detail in connection with the dispenser of FIGS. 1–4 and 6–27. Modifications to the dispenser will be readily apparent to those of skill in the art. For example, one could provide more than one metering member on metering carriage 344 to penetrate the stack as shown schematically in FIG. 28. FIG. 28 is a schematic view wherein a support platform 484 is shown schematically in a view similar to FIG. 19 (i.e., similar to platform 410) showing a dispensing aperture 486, also generally C-shaped and two metering members 488,490 which operate equivalently to metering member 442 in dispenser 310 to urge folded napkins through the aperture. So also, one might configure a trap door/metering member combination in various ways, for example one could provide a support shutter on a lever adjacent a metering member on a lever which are both laterally and axially offset but move in the same direction to dispense napkins in accordance with the invention. That is to say, a sliding floor/sliding metering member which travel together across the lower part of a gravity feed napkin dispenser could be constructed within the spirit and scope of the present invention. So also, while it is typical to move the metering member in; accordance with the present invention, it is likewise possible to provide for a stationary metering member and move the napkin magazine of the napkin dispenser relative thereto. Such modifications are within the spirit and scope of the present invention which is set forth in the appended claims.

What is claimed is:

1. A product metering napkin dispenser comprising:

(a) a napkin magazine for receiving a stack of folded napkins;

(b) shelf means for releasably retaining said stack of folded napkins about a terminal portion of said napkin magazine;

(c) a metering member; and (d) means for providing relative motion between said metering member and said shelf means, wherein said shelf means, metering member and said means for providing relative motion between said metering member and said shelf means are configured and arranged such that said metering member penetrates said stack of napkins a predetermined distance from said shelf means in a metering operation thereby segregating a predetermined number of napkins from the remainder of said stack for dispensing, and wherein said shelf means are movable with respect to said stack of folded napkins in said napkin magazine, and are rotatably mounted about a shaft and are configured to release napkins upon rotation of said shaft.

2. The napkin dispenser according to claim 1, wherein said metering member comprises a pivotally mounted member adapted to penetrate said stack in a metering operation.

3. The napkin dispenser according to claim 1, wherein said metering member comprises a member rotatably mounted about a shaft.

4. The napkin dispenser according to claim 1, wherein said metering member is mounted on a metering carriage adapted for reciprocating motion with respect to said stack of folded napkins.

5. A product metering napkin dispenser comprising:

(a) a housing defining a napkin magazine for receiving a stack of folded napkins;

(b) a movable retaining shutter mounted to rotate in a dispensing plane for retaining said stack of napkins in said housing in a closed position;

(c) a metering shutter mounted to rotate concurrently with said movable retaining shutter at a predetermined distance from said retaining shutter, wherein said movable retaining shutter and metering member are positioned, configured and dimensioned to cooperate to dispense a predetermined number of napkins in a dispensing operation where upon rotation of said retaining shutter and said metering shutter:

(i) said metering shutter revolves to penetrate said stack of folded napkins at said predetermined distance from said movable support shutter thereby segregating said predetermined number of napkins from the remainder of napkins in said stack and thereby retaining the remainder of napkins in said stack in said housing; and (ii) said movable support shutter revolves to an open position thereby releasing said predetermined number of napkins.

6. The napkin dispenser according to claim 5, wherein said retaining shutter is generally semi-circular disk-shaped.

7. The napkin dispenser according to claim 6, wherein said retaining shutter has a downwardly inclined trailing portion configured to facilitate the release of said predetermined number of napkins.

8. The napkin dispenser according to claim 7, wherein said metering shutter is generally semi-circular disk-shaped.

9. The napkin dispenser according to claim 8, wherein said metering shutter is provided with a blunted knife-edge adapted to penetrate said stack of folded napkins.

10. The napkin dispenser according to claim 9, wherein said metering shutter is provided with a slot portion proximate to said blunted knife edge of said metering shutter.

11. The napkin dispenser according to claim 10, further comprising means for adjusting the predetermined distance between said retaining shutter and said metering shutter.

12. The napkin dispenser according to claim 11, further comprising biasing means to urge said support shutter to said closed position.

13. A product metering, gravity feed napkin dispenser comprising:

(a) a housing defining a napkin magazine for receiving a stack of folded napkins;

(b) a rotatable shaft mounted in said housing;

(c) a movable support shutter mounted on said shaft to rotate in a dispensing plane for supporting said stack of napkins about the lower portion of said napkin magazine in a closed position;

(d) a metering shutter mounted on said shaft to rotate concurrently with said movable shutter at a predetermined distance above said support shutter; and (e) drive means coupled to said shaft for imparting rotational motion thereto, wherein said movable support shutter, metering shutter, shaft and drive means are positioned, configured and dimensioned to cooperate to dispense a predetermined number of napkins in a dispensing operation where upon rotation of said shaft:

(i) said metering shutter revolves to penetrate said stack of folded napkins a predetermined distance above said movable support shutter thereby segregating said predetermined number of napkins from the remainder of napkins in said stack and thereby supporting the remainder of napkins in said stack; and (ii) said movable support shutter revolves to an open position thereby releasing said predetermined number of napkins.

14. The napkin dispenser according to claim 13, wherein said support shutter is generally semi-circular disk-shaped.

15. The napkin dispenser according to claim 13, wherein said support shutter has a downwardly inclined trailing portion configured to facilitate the release of said predetermined number of napkins.

16. The napkin dispenser according to claim 13, wherein said metering shutter is generally semi-circular disk-shaped.

17. The napkin dispenser according to claim 13 wherein said metering shutter is provided with a blunted knife-edge adapted to penetrate said stack of folded napkins.

18. The napkin dispenser according to claim 17, wherein said metering shutter is provided with a slot position proximately to said blunted knife edge of said metering shutter.

19. The napkin dispenser according to claim 13, further comprising means for adjusting the predetermined distance between said support shutter and said metering shutter.

20. The napkin dispenser according to claim 13, further comprising biasing means to urge said support shutter to said closed position.

21. The napkin dispenser according to claim 20, wherein said biasing means comprise a biasing spring about said rotatable shaft.

22. The napkin dispenser according to claim 21, wherein said drive means comprise gear mounted on said rotatable shaft and a rack mounted on a drive member slidably secured to said housing.

23. A product metering napkin dispenser comprising:

(a) a housing defining a napkin magazine for receiving a stack of folded napkins;

(b) a retaining member releasably supporting said stack of folded napkins about a dispensing plane at a terminal portion of said napkin magazine;

(c) a metering carriage provided with a napkin metering member projecting from said metering carriage;

(d) a guide configured for directing said metering carriage during operation of said napkin dispenser, said guide having an inward portion and an outward portion, said inward portion being disposed proximately to said stack of folded napkins for guiding said metering carriage during a dispensing stroke over which napkins are dispensed and said outward portion being disposed outwardly with respect to said inward portion for guiding said metering carriage following said dispensing stroke;

(e) biasing means to urge said metering carriage to a rest position; and (f) drive means coupled to said metering carriage for advancing said metering carriage along said guide in the dispensing cycle, said drive means being generally adapted to overpower the force exerted on the metering carriage by said biasing means, said guide and metering carriage being configured and arranged such that during said dispensing stroke said metering member penetrates said stack of folded napkins at a predetermined distance from said dispensing plane and exerts a force on a predetermined number of folded napkins which are thereby released from said retaining member as said metering carriage advances along said inward portion of said guide.

24. The product metering napkin dispenser according to claim 23, wherein said retaining member comprises a generally planar member defining a dispensing aperture having a length substantially shorter than the dispensing length of said napkins.

25. The product metering napkin dispenser according to claim 24, wherein said dispensing aperture has a length of from about 10% to about 30% shorter than the dispensing length of said napkins.

26. The product metering napkin dispenser according to claim 25, wherein said dispensing aperture has a length of from about 15% to about 25% shorter than the dispensing length of said napkins.

27. The product metering napkin dispenser according to claim 24, wherein the width of said dispensing aperture is less than the dispensing width of said napkins.

28. The product metering napkin dispenser according to claim 23 further comprising a gripping member adapted to cooperate with said metering member to grip said predetermined number of folded napkins between said metering member and said gripping member during said dispensing stroke.

29. The product metering napkin dispenser according to claim 23, further comprising second biasing means adapted to urge said gripping member towards said metering member during said dispensing stroke.

30. The product metering napkin dispenser according to claim 29, further comprising third biasing means adapted to urge said gripping member away from said metering member at about the completion of said dispensing stroke and to urge said metering carriage towards said outer portion of said guide at about the completion of said dispensing stroke.

31. The product metering napkin dispenser according to claim 30, further comprising fourth biasing means for urging said metering carriage towards said inner portion of said guide from said rest position.

32. The product metering napkin dispenser according to claim 31, wherein said metering carriage is provided with a plurality of mounting shafts and said guide comprises a pair of opposed tracks for receiving said mounting shafts.

33. A product metering, gravity feed napkin dispenser comprising:

(a) a housing defining a storage chamber for receiving a stack of folded napkins, said folded napkins presenting a folded napkin length and a folded napkin width at the bottom of said stack;

(b) a support releasably supporting said stack of folded napkins about a dispensing plane at the lower extremity of said storage chamber;

(c) a reciprocating metering member; and (d) means for mounting said reciprocating metering member including means for biasing said reciprocating metering member towards a rest position; and (e) drive means coupled to said means for mounting said reciprocating metering member;

wherein the aforesaid components are constructed and arranged such that said drive means advance said reciprocating metering member in a dispensing stroke where the reciprocating metering member penetrates said stack of napkins a predetermined distance above said dispensing plane corresponding to a predetermined number of folded napkins and exerts a downward force thereon as the metering member advances in said dispensing stroke.

34. The product metering, gravity feed napkin dispenser according to claim 33, wherein said means for mounting said reciprocating metering member includes a metering carriage provided with a plurality of mounting shafts and said guide comprises a pair of opposed tracks for receiving said mounting shafts.

35. The product metering, gravity feed napkin dispenser according to claim 34, wherein said support comprises a generally planar member defining a dispensing aperture having a length substantially shorter than the dispensing length of said napkins.

36. The product metering, gravity feed napkin dispenser according to claim 35, wherein the width of said dispensing aperture is less than the dispensing width of said napkins.

37. The product metering, gravity feed napkin dispenser according to claim 35, further comprising a gripping member adapted to cooperate with said metering member to grip said predetermined number of folded napkins between said metering member and said gripping member and second biasing means adapted to urge said gripping member towards said metering member during said dispensing stroke.

38. A method of dispensing a predetermined number of folded napkins comprising:

(a) disposing a stack of folded napkins in a napkin magazine about a retaining member releasably retaining said stack;

(b) penetrating said stack with a metering member such that said metering member is between said predetermined number of napkins and the remainder of napkins in said stack; and (c) providing relative motion between said retaining member and said metering member operative to dispense said predetermined number of napkins;

wherein said retaining member comprises a movable support shutter mounted to rotate in a dispensing plane about the lower portion of said napkin magazine.

39. The method according to claim 38, wherein said metering member comprises a metering shutter mounted to rotate concurrently with said movable support shutter.

40. The method according to claim 39, wherein said movable support shutter and said metering shutter are mounted on a rotatable shaft.

41. The method according to claim 39, wherein said metering shutter revolves to penetrate said stack and support the remainder of said stack during a dispensing operation and said movable support shutter revolves away from said stack to an open position during a dispensing operation, thereby releasing said predetermined number of napkins.

42. The method according to claim 39, wherein said support shutter and said metering shutter are generally semi-circular disk-shaped.

43. A method of dispensing a predetermined number of folded napkins comprising:

(a) disposing a stack of folded napkins in a napkin magazine about a retaining member releasably retaining said stack;

(b) penetrating said stack with a metering member such that said metering member is between said predetermined number of napkins and the remainder of napkins in said stack; and (c) providing relative motion between said retaining member and said metering member operative to dispense said predetermined number of napkins;

wherein said retaining member comprises a generally C-shaped aperture.

44. The method according to claim 43, wherein said metering member moves downwardly in a dispensing stroke to urge said predetermined number of napkins through said aperture in a dispensing operation.

45. The method according to claim 44, wherein said metering member is biased upwardly.

46. A method of dispensing a predetermined number of folded napkins comprising:

(a) disposing a stack of folded napkins in a napkin magazine about a retaining member releasably retaining said stack;

(b) penetrating said stack with a metering member such that said metering member is between said predetermined number of napkins and the remainder of napkins in said stack; and (c) providing relative motion between said retaining member and said metering member operative to dispense said predetermined number of napkins;

wherein a gripping member cooperates with said metering member to grip said predetermined number of napkins during said dispensing operation.

47. A method of dispensing a predetermined number of folded napkins comprising:

(a) disposing a stack of folded napkins in a napkin magazine about a retaining member releasably retaining said stack;

(b) penetrating said stack with a metering member such that said metering member is between said predetermined number of napkins and the remainder of napkins in said stack; and (d) providing relative motion between said retaining member and said metering member operative to dispense said predetermined number of napkins;

wherein said metering member is mounted in a metering carriage coupled to guide means for directing the motion of said carriage during operation of said napkin dispenser.

* * * * *

UNITED STATES PATENT AND TRADEMARK OFFICE

CERTIFICATE OF CORRECTION

PATENT NO. : 6,892,898 B1
DATED : May 17, 2005
INVENTOR(S) : Bruce T. Boone et al.

It is certified that error appears in the above-identified patent and that said Letters Patent is hereby corrected as shown below:

Column 1,
Line 5, after “a” insert -- divisional --;

Column 3,
Lines 16-17, change “positioned configured dimensioned” to -- positioned, configured and dimensioned --;

Column 4,
Line 4, insert -- number -- after “pre-determined”;

Column 6,
Line 65, change “farther” to -- further --;

Column 7,
Line 12, insert -- a -- before “three”;
Line 23, change “dispending” to -- dispensing --;
Lines 24-25, change “four fold” to -- four-fold --;

Column 9,
Line 56, change “directions” to -- direction --;

Column 11,
Line 55, delete “,”;
Line 57, change “it” to -- its --;

Column 13,
Line 11, insert -- in -- before “FIGS.”;
Line 55, change “;” to -- , --;
Line 56, change “356” to -- 356, --;

Column 14,
Line 32, delete the first instance of “number of”;
Line 33, delete the first instance of “the”;
Line 42, change “invented” to -- inventive --;

Column 15,
Line 35, change “FIG.” to -- FIGS. --;
Line 41, change “26” to -- 26), --;
Line 55, change “member” to -- members --;

UNITED STATES PATENT AND TRADEMARK OFFICE

CERTIFICATE OF CORRECTION

PATENT NO. : 6,892,898 B1
DATED : May 17, 2005
INVENTOR(S) : Bruce T. Boone et al.

It is certified that error appears in the above-identified patent and that said Letters Patent is hereby corrected as shown below:

Column 17,
Line 42, change “in;” to -- in --;

Column 20,
Line 64, delete “and”; and

Column 22,
Line 51, change “d” to -- (c) --.

Signed and Sealed this

First Day of November, 2005

JON W. DUDAS
*Director of the United States Patent and Trademark Office*